US007306311B2

(12) United States Patent
Yamanobe

(10) Patent No.: US 7,306,311 B2
(45) Date of Patent: Dec. 11, 2007

(54) COLOR INK DEPOSITION ORDER DETERMINATION METHOD, AND IMAGE FORMING METHOD AND APPARATUS

(75) Inventor: Jun Yamanobe, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 84 days.

(21) Appl. No.: 11/356,260

(22) Filed: Feb. 17, 2006

(65) Prior Publication Data

US 2006/0187254 A1 Aug. 24, 2006

(30) Foreign Application Priority Data

Feb. 18, 2005 (JP) ..... 2005-042629

(51) Int. Cl.
*B41J 2/205* (2006.01)
*B41J 2/21* (2006.01)

(52) U.S. Cl. ..... 347/15; 347/43

(58) Field of Classification Search ..... 347/15, 347/43

See application file for complete search history.

(56) References Cited

U.S. PATENT DOCUMENTS 6,533,382 B1 * 3/2003 Tomida et al. ..... 347/15
7,128,394 B2 * 10/2006 Takenaka ..... 347/43

FOREIGN PATENT DOCUMENTS

| | | |
|---|---|---|
| JP | 62-161541 A | 7/1987 |
| JP | 10-166712 A | 6/1998 |
| JP | 2003-112469 A | 4/2003 |

* cited by examiner

*Primary Examiner*—Thinh Nguyen
(74) *Attorney, Agent, or Firm*—Birch, Stewart, Kolasch & Birch, LLP

(57) ABSTRACT

A method determines a color ink deposition order when inks of a plurality of colors are overlapped on one another to form an image on a recording medium. The method comprises the steps of: obtaining information on OD_β(α) concerning an ink of a first color α and OD_α(β) concerning an ink of a second color β, where OD_β(α) is a reflection density in a range of a color complementary to the second color β in a deposition sample obtained when only the ink of the first color α is deposited, and OD_α(β) is a reflection density in a range of a color complementary to the first color α in a deposition sample obtained when only the ink of the second color β is deposited; and determining the color ink deposition order so that of one of the inks of the first color α and the second color β which one corresponds to smaller one of OD_β(α) and OD_α(β) is first deposited and the other of the inks of the first color α and the second color β is subsequently deposited.

20 Claims, 21 Drawing Sheets

| C AND M | M AND Y | Y AND C | DEPOSITION ORDER | |
|---|---|---|---|---|
| OD_C(M)>OD_M(C) (C→M) | OD_M(Y)>OD_Y(M) (M→Y) | OD_Y(C)>OD_C(Y) (Y→C) | | (a) |
| | | OD_Y(C)<OD_C(Y) (C→Y) | C→M→Y | (b) |
| | OD_M(Y)<OD_Y(M) (Y→M) | OD_Y(C)>OD_C(Y) (Y→C) | Y→C→M | (c) |
| | | OD_Y(C)<OD_C(Y) (C→Y) | C→Y→M | (d) |
| OD_C(M)<OD_M(C) (M→C) | OD_M(Y)>OD_Y(M) (M→Y) | OD_Y(C)>OD_C(Y) (Y→C) | M→Y→C | (e) |
| | | OD_Y(C)<OD_C(Y) (C→Y) | M→C→Y | (f) |
| | OD_M(Y)<OD_Y(M) (Y→M) | OD_Y(C)>OD_C(Y) (Y→C) | Y→M→C | (g) |
| | | OD_Y(C)<OD_C(Y) (C→Y) | | (h) |

FIG.3

| C AND M | M AND Y | Y AND C | DEPOSITION ORDER | |
|---|---|---|---|---|
| OD_C(M)>OD_M(C) (C→M) | OD_M(Y)>OD_Y(M) (M→Y) | OD_Y(C)>OD_C(Y) (Y→C) | | (a) |
| | | OD_Y(C)<OD_C(Y) (C→Y) | C→M→Y | (b) |
| | OD_M(Y)<OD_Y(M) (Y→M) | OD_Y(C)>OD_C(Y) (Y→C) | Y→C→M | (c) |
| | | OD_Y(C)<OD_C(Y) (C→Y) | C→Y→M | (d) |
| OD_C(M)<OD_M(C) (M→C) | OD_M(Y)>OD_Y(M) (M→Y) | OD_Y(C)>OD_C(Y) (Y→C) | M→Y→C | (e) |
| | | OD_Y(C)<OD_C(Y) (C→Y) | M→C→Y | (f) |
| | OD_M(Y)<OD_Y(M) (Y→M) | OD_Y(C)>OD_C(Y) (Y→C) | Y→M→C | (g) |
| | | OD_Y(C)<OD_C(Y) (C→Y) | | (h) |

FIG.7

| C AND M | M AND Y | Y AND C | DEPOSITION ORDER | |
|---|---|---|---|---|
| C→M | M→Y | Y→C | | (a) |
| | | C→Y | C→M→Y | (b) |
| | Y→M | Y→C | Y→C→M | (c) |
| | | C→Y | C→Y→M | (d) |
| M→C | M→Y | Y→C | M→Y→C | (e) |
| | | C→Y | M→C→Y | (f) |
| | Y→M | Y→C | Y→C→M | (g) |
| | | C→Y | | (h) |

DEPOSITION ORDER 1

DEPOSITION ORDER 2

COLOR INK DEPOSITION ORDER DETERMINATION METHOD, AND IMAGE FORMING METHOD AND APPARATUS

BACKGROUND OF THE INVENTION

1. Field of the Invention

The present invention relates to a color ink deposition order determination method, image forming method, and image forming apparatus. In particular, the present invention are suitable to an inkjet printer that uses a plurality of colors of inks, and relates to a method for determining an order of depositing droplets of the inks, a method and an image forming apparatus for forming an image by depositing ink droplets in the determined deposition order.

2. Description of the Related Art

Many of the inkjet printers which are used in color printing form an image using a plurality of colors of inks including four colors of cyan (C), magenta (M), yellow (Y), and black (K). Regarding an order of depositing the plurality of colors of inks, Japanese Patent Application Publication No. 62-161541 discloses a method where ink with low brightness is firstly deposited. Japanese Patent Application Publication No. 2003-112469 discloses an inkjet recording method for using six pigment inks of black, light cyan, cyan, light magenta, magenta, and yellow, in which the pigment inks with high coloring power are deposited by priority.

In a shuttle scan type inkjet printer that causes a recording head to scan a predetermined image region more than once in order to record an image, ink droplets can be deposited by the shingling printing method so that the order of overlapped dots is changed. However, in a single pulse type inkjet printer that records an image by scanning once, the order of deposition of color inks (for example, C, M, and Y) is determined only by the order of disposed heads of the colors. For this reason, in the single pulse type printer, intended color density may not be obtained depending on the arrangement order of the heads of the color inks.

Such a problem is described with reference to FIGS. 21A and 21B as an example. FIGS. 21A and 21B are cross sectional views that schematically show a state in which ink is deposited on pixels A and B, which are adjacent to each other on a recording medium. In this case, it is considered that cyan (C) and magenta (M) inks are deposited on the pixel A and cyan (C) ink is deposited on the pixel B, in the predetermined orders including the order of C to M. Each dotted line in FIGS. 21A and 21B indicates the central position of each pixel, and diameter D indicates the dot diameter. In FIG. 21B, the diameter D of each dot is approximately three times greater than the distance between the pixels (pixel pitch Pp). FIGS. 21A and 21B show dots where droplets are deposited so as to overlap from bottom to top in the order of landing on the recording medium.

Specifically, FIG. 21A shows a state in which the inks are deposited in the order of C ink on the pixel A, M ink on the pixel A, and C ink on the pixel B (referred to as "deposition order 1"). FIG. 21B shows a state in which the inks are deposited in the order of C ink on the pixel A, C ink on the pixel B, and M ink on the pixel A (referred to as "deposition order 2").

In the shuttle type printer, deposition orders of color inks can be controlled in units of recording pixels, and thus the shuttle type printer can adopt either patterns of the deposition order 1 shown in FIG. 21A or the deposition order 2 shown in FIG. 21B. In the single pulse type printer, on the other hand, a deposition order is uniquely determined by the arrangement order of the heads, and thus the single pulse type printer can adopt only the deposition order 2 shown in FIG. 21B of the deposition orders.

In the deposition order 2 shown in FIG. 21B, supposedly when the C ink has the properties of hardly reflecting (easily transmitting) light of the complementary color of M (i.e., light of green) and the M ink has the properties of easily reflecting (hardly transmitting) light of the complementary color of C (i.e., light of red), then the color of C can be almost invisible in a region Q (a region in which the uppermost layer contains the M ink) shown in FIG. 21B.

It should be noted that, for convenience of explanation hereinafter, "light of a complementary color of $\alpha$" is described as "light of an $\alpha$ wavelength range". For example, "light of an M wavelength range" means light of green.

A case where two colors of inks $\alpha$ and $\beta$ (inks $\alpha$ and $\beta$ are any of cyan ink, magenta ink, and yellow ink) are deposited is described below.

Suppose that the reflection density corresponding to the $\alpha$ wavelength range is $OD_\alpha(\alpha)$ and the reflection density corresponding to the $\beta$ wavelength range is $OD_\beta(\alpha)$ when only the ink $\alpha$ is deposited, and that the reflection density corresponding to the $\alpha$ wavelength range is $OD_\alpha(\beta)$ and the reflection density in the $\beta$ wavelength range corresponding to $OD_\beta(\beta)$ when only the ink of $\beta$ is deposited.

In this case, it is assumed that the conditions of $0<OD_\beta(\alpha)<<OD_\alpha(\alpha)$, and $0<OD_\alpha(\beta)<<OD_\beta(\beta)$ are satisfied. It should be noted that an expression of "X<<Y" indicates that Y is much greater than X.

In an ideal color material (so called "block dye"), $OD_\beta(\alpha)=OD_\alpha(\beta)=0$ is satisfied. However, sub-absorption occurs in an actual color material, and thus $OD_\beta(\alpha)$ and $OD_\alpha(\beta)$ become larger than zero.

Suppose that the relation of $OD_\beta(\alpha)>OD_\alpha(\beta)$ is satisfied, a case where the inks $\alpha$ and $\beta$ are deposited so as to overlap with each other is described below.

When the ink $\alpha$ is first deposited and the ink $\beta$ is subsequently deposited, then the ink $\beta$ that has been deposited later has the characteristics of easily reflecting the light of the $\alpha$ wavelength range (i.e., the density corresponding to the a range is small) according to the relation of $OD_\beta(\alpha)>OD_\alpha(\beta)$. Thus, as the ink $\beta$ overlaps more, the lower the density of the ink $\alpha$ placed below $\beta$ becomes.

Such phenomenon is especially conspicuous in a case in which pigment inks are used. Even when the same types of pigment inks are used, the rate of the above-mentioned reduction of the density changes as the particle diameter of the pigment changes. Further, the above-mentioned rate of reduction of the density changes because of the spectral characteristics of the covering power of the ink.

FIG. 22 shows a density measurement result of a sample of a single color of each of cyan and magenta, and that of a sample of the two colors that overlap with each other. The horizontal axis indicates the cyan (C) density and the vertical axis indicates the magenta (M) density. In this case, the color material M easily reflects light of the C wavelength range at the surface of the color material M. Thus, if the color inks C and M are overlapped in the order of C to M, then it can be observed that the density of the ink C is reduced more than that when only the ink C is deposited (see the curved arrow in FIG. 22).

This depends largely on the spectral characteristics of the color materials, and the above-described phenomena are not considered in either Japanese Patent Application Publication Nos. 62-161541 or 2003-112469.

SUMMARY OF THE INVENTION

The present invention has been contrived in view of such circumstances, objects thereof are to provide a method for determining an appropriate deposition order depending on the spectral characteristics of inks, and to provide an image forming method and apparatus which are capable of forming an image with higher density (higher color reproductiveness) under the conditions that the same ink is used and the same amount of droplets are deposited, in comparison with the related art.

In order to attain the aforementioned object, the present invention is directed to a method of determining a color ink deposition order when inks of a plurality of colors are overlapped on one another to form an image on a recording medium, the method comprising the steps of: obtaining information on OD_β(α) concerning an ink of a first color α and OD_α(β) concerning an ink of a second color β, where OD_β(α) is a reflection density in a range of a color complementary to the second color β in a deposition sample obtained when only the ink of the first color α is deposited, and OD_α(β) is a reflection density in a range of a color complementary to the first color α in a deposition sample obtained when only the ink of the second color β is deposited; and determining the color ink deposition order so that of one of the inks of the first color α and the second color β which one corresponds to smaller one of OD_β(α) and OD_α(β) is first deposited and the other of the inks of the first color α and the second color β is subsequently deposited.

According to this aspect of the invention, the reflection density in the complementary color range concerning another ink is obtained when color ink for each color is used as a single color, and the deposition order of the color inks are determined on the basis of the magnitude relationship between the reflection densities. Specifically, if the relation of OD_β(α)>OD_α(β) is satisfied, then the ink of the second color β is first deposited, and the ink of the first color α is subsequently deposited. On the other hand, if the relation of OD_α(β)>OD_β(α) is satisfied, then the ink of the first color α is first deposited, and the ink of the second color β is subsequently deposited.

By employing such deposition order, reduction of the density of the first deposited color is small, and in comparison with the related art, an image with higher density (higher color reproductiveness) can be formed.

It should be noted that information on the reflection densities may be obtained by actually ejecting inks as the sample in order to measure the reflection densities thereof, or may be obtained by taking values obtained previously as the information (obtained by means of inputting a numerical value through a user interface, or reading in data through a communication interface) on the basis of an experiment or the like.

Preferably, the first color α and the second color β are two colors selected from among three colors of cyan, magenta, and yellow.

The present invention can be applied as a method for determining deposition orders of three colors in the inkjet recording apparatus that uses at least three color inks, cyan (C), magenta (M), and yellow (Y).

Preferably, the method further comprises the steps of: where OD_M (C) is a reflection density in a range of color complementary to magenta in a deposition sample obtained when only cyan ink is deposited, OD_C (M) is a reflection density in a range of color complementary to cyan in a deposition sample obtained when only magenta ink is deposited, OD_Y (M) is a reflection density in a range of color complementary to yellow in a deposition sample obtained when only the magenta ink is deposited, OD_M (Y) is a reflection density in the range of color complementary to magenta in a deposition sample obtained when only yellow ink is deposited, OD_C (Y) is a reflection density in the range of color complementary to cyan in a deposition sample obtained when only the yellow ink is deposited, and OD_Y (C) is a reflection density in the range of color complementary to yellow in a deposition sample obtained when only the cyan ink is deposited, in one of a case where all of inequalities of OD_C (M)>OD_M (C), OD_M (Y)>OD_Y (M), and OD_Y (C)>OD_C (Y) are satisfied and a case where all of inequalities of OD_C (M)<OD_M (C), OD_M (Y)<OD_Y (M), and OD_Y (C)<OD_C (Y), obtaining values of |OD_C (M)−OD_M (C)|, |OD_M (Y)−OD_Y (M)|, and |OD_Y (C)−OD_C (Y)| and selecting two pairs of the colors corresponding to larger two of the obtained values; and determining the color ink deposition order of the inks of cyan, magenta, and yellow according to the inequalities corresponding to the two pairs of the colors.

In the case in which the deposition orders are determined for each combination (of three combinations) of two colors selected randomly from among the three color inks of C, M, and Y in accordance with the method according to the present invention, two cases can occur, that is, a case in which the deposition order of the three colors is uniquely determined by considering the deposition orders of the combinations, and a case in which the deposition order of the three colors cannot be uniquely determined because of the relationships of the deposition orders of the combinations being so-called "three-cornered deadlock".

According to this aspect of the invention, a processing method for determining the deposition order of the three colors in the case of the relationship of "three-cornered deadlock" is provided. Specifically, of the three inequalities used for evaluating the reflection densities of each of the combinations, the deposition order of the three colors is determined using a result of the top two combinations of which the density differences (absolute values of the differences in the reflection densities) are larger than the density difference of the other combination. An influence on the densities by ignoring the result of the combination of two colors between which the density difference is smallest is the smallest on the whole, and thus the appropriate deposition order can be obtained from the result of the top two combinations.

Preferably, each of the deposition samples is created by depositing the ink of an amount per unit area corresponding to an amount in a case where the ink is deposited at a maximum dot density.

Regarding a deposition condition of a deposition sample, it is preferable that the reflection density for the sample is measured when the ink is deposited at the maximum recording density (maximum dot density) at which deposition can be performed and which is determined according to the conditions of the apparatus, because of the improved accuracy in determination of the deposition order.

The present invention is also directed to a method of determining a color ink deposition order when inks of a plurality of colors are overlapped on one another to form an image on a recording medium, the method comprising the steps of: obtaining information on OD_α(α→β), OD_β(α→β), OD_α(β→α), and OD_β(β→α), where OD_α(α→β) is a reflection density in a range of a color complementary to a first color α in a deposition sample obtained when an ink of a second color β is deposited on an ink of the first color α, OD_β(α→β) is a reflection density in a range of a color complementary to the second color β in the deposition sample obtained when the ink of the second color β is deposited on the ink of the first color α, OD_α(β→α) is a reflection density in the range of the color complementary to the first color α in a deposition sample obtained when the ink of the first color α is deposited on the ink of the second color β, and OD_β(β→α) is a reflection density in the range of the color complementary to the second color β in the deposition sample obtained when the ink of the first color α is deposited on the ink of the second color β; and determining the color ink deposition order of the inks of the first color α and the second color β according to values of OD_α(α→β), OD_β(α→β), OD_α(β→α), and OD_β(β→α).

According to this aspect of the invention, the reflection densities of the sample of a color (secondary color) obtained when two colors of inks are deposited so as to overlap on each other are obtained, and then the deposition order for the color inks are determined on the basis of the magnitude relationship of the reflection densities. Specifically, for a combination of two colors (α, β), information on the reflection densities of a sample obtained by depositing in the order of α to β, and on the reflection densities of a sample obtained by depositing in the order of β to α (on the reflection densities in the complementary color range for each color of α and β) is obtained to determine the deposition order according to the values of the reflection densities.

Of the two samples in which the deposition orders are switched, by selecting the deposition order in which reproduction of higher density is possible, an image with high color reproductiveness can be formed, in comparison with the related art. Moreover, since the refection density is determined with the sample obtained by actually overlapping the two colors, the deposition order can be determined more appropriately.

Preferably, if conditions of OD_α(β→α)>OD_α(α→β) and OD_β(β→α)>OD_β(α→β) are satisfied, then the color ink deposition order is determined so that the ink of the second color β is first deposited and the ink of the first color α is subsequently deposited.

The conditions of the inequalities described above indicate that when the ink deposition is performed in the order of the ink β to the ink α, both of the density in the complementary color range with respect to the color α and the density in the complementary color range with respect to the color β are larger, compared to the case in which the ink deposition is performed in the order of the ink α to the ink β. When such conditions are satisfied, it is preferable that the deposition is performed in the order of the ink β to the ink α.

Preferably, if conditions of OD_α(α→β)>OD_α(β→α) and OD_β(α→β)>OD_β(β→α) are satisfied, then the color ink deposition order is determined so that the ink of the first color α is first deposited and the ink β of the second color β is subsequently deposited.

The conditions of the inequalities described above indicate that when the ink deposition is performed in the order of the ink α to the ink β, both of the density in the complementary color range with respect to the color α and the density in the complementary color range with respect to the color β are larger, compared to the case in which the ink deposition is performed in the order of the ink β to the ink α. When such conditions are satisfied, it is preferable that the deposition is performed in the order of the ink α to the ink β.

Preferably, if conditions of OD_α(β→α)>OD_α(α→β) and OD_β(β→α)>OD_β(α→β) are satisfied, then the method further comprises the steps of: obtaining information on OD_α(α) and OD_β(β), where OD_α(α) is a reflection density in the range of the color complementary to the first color α in a deposition sample obtained when only the ink of the first color α is deposited, and OD_β(β) is a reflection density in the range of the color complementary to the second color β in a deposition sample obtained when only the ink of the second color β is deposited; obtaining a first value of {OD_α(α)−OD_α(α→β)} and a second value of {OD_β(β)−OD_β(β→α)}; and determining the color ink deposition order so that the ink of the first color α is first deposited and the ink β of the second color β is subsequently deposited if the first value is smaller than the second value, and the ink of the second color β is first deposited and the ink of the first color α is subsequently deposited if the second value is smaller than the first value.

The conditions of the inequalities described above indicate that the densities of the colors that have been first deposited (colors located below) get smaller. When such conditions are satisfied, it is preferable to determine the order of the ink deposition as follows. Specifically, the reflection density when only the ink of the color is deposited on the recording medium is compared to the reflection density when the ink of the color is deposited below the ink of another color, and the change value of the reflection density is obtained. It is desirable that the ink that has the smaller change value be first deposited and the ink that has the larger change value be subsequently deposited.

Preferably, the first color α and the second color β are two colors selected from among three colors of cyan, magenta, and yellow.

The present invention can be applied as a method for determining the deposition order of three colors in the inkjet recording apparatus that uses at least three color inks, C, M, and Y.

The present invention is also directed to a color ink deposition order determination method, comprising the steps of: determining deposition orders of inks of two colors in combinations of cyan and magenta, magenta and yellow, and yellow and cyan, according to the above-described method; if the deposition order of the inks of three colors cyan, magenta, and yellow is not uniquely determined according to the determined deposition orders, then obtaining change values of the combinations, each of the change values being a change value between the reflection density obtained when the inks of the two colors are deposited in the determined deposition order and a reflection density obtained when the inks of the two colors are deposited in an order reverse to the determined deposition order; selecting two of the combinations of which the change values are larger than the change value of the other combination; and determining the color ink deposition order of the inks of the three colors, cyan, magenta, and yellow according to the determined deposition orders corresponding to the selected two combinations.

In the case in which the deposition orders are determined for each combination (of three combinations) of two colors selected randomly from among the three color inks of C, M, and Y according to the method described above, two cases can occur, that is, a case in which the deposition order of the three colors is uniquely determined by considering the deposition orders of the combinations, and a case in which the deposition order of the three colors cannot be uniquely determined because the relationship of the deposition orders of the combinations are so-called "three-cornered deadlock".

According to this aspect of the invention, a processing method for determining the deposition order of the three colors in the case of the relationship of "three-cornered deadlock" is provided. Specifically, the deposition order of the three colors is determined by employing the result of the top two combinations of which the change values (deducted values) between the densities when the deposition is performed in the orders of the determined deposition orders for the combinations and the densities when the deposition is performed in the reversal deposition orders are larger (i.e., a result of a combination in which the change value of the density is smallest is ignored). An influence on the densities by ignoring the result of the combination in which the change value between the densities when the deposition orders are switched is smallest is the smallest on the whole, and thus the deposition order can be appropriately obtained from the result of the top two combinations.

Preferably, each of the deposition samples is created by depositing the ink of an amount per unit area corresponding to a half of an amount in a case where the ink is deposited at a maximum dot density.

Although the deposition conditions for the deposition samples are not particularly limited, it is preferable that the amount of each deposition per unit area is ½ of the amount of the maximum deposition (deposition amount which is realized when the deposition is performed at the maximum dot density) assumed for the unit area.

It should be noted that an embodiment is possible in which a program for causing a computer to execute the steps in the color ink deposition order determination method described above is provided. The program may be configured as single application software, or incorporated as a part of other application such as image editing software or design support software. The above-mentioned program can be recorded in a CD-ROM, magnetic disk, or other information recording medium (external storage device). Moreover, the above-mentioned program can be provided to a third party through the information recording medium. Furthermore, a download service of the program can be provided through a communication line such as the Internet.

The present invention is also directed to an image forming method, comprising the steps of: determining a color ink deposition order according to the above-described method; and ejecting the inks of the colors to form a color image according to the determined color ink deposition order.

According to this aspect of the invention, an image with high color reproductiveness can be formed.

The present invention is also directed to an image forming apparatus comprising ink ejection heads for the inks of the colors, the heads being disposed from upstream side to downstream side with respect to a conveyance direction of the recording medium in accordance with the color ink deposition order determined according to the above-described method.

In a configuration in which an image is recorded while the ejection head is moved relatively with respect to the recording medium (perform scanning), if a single pulse type image forming apparatus which records an image by scanning once in a predetermine image region is used, then the alignment order (arrangement order) of the ink ejection heads of the colors corresponds to the deposition order. Therefore, it is preferable that the arrangement order of the ink ejection heads of the colors be designed according to the deposition order, which is determined on the basis of the color ink deposition order determination method described above. According to this aspect of the invention, an image with high color reproductiveness can be formed.

As a configuration example of the ink ejection head in the image forming apparatus according to the above-mentioned aspects of the present invention, it is possible to use a full-line type inkjet head which has a nozzle row in which a plurality of nozzles are arrayed throughout the length corresponding to entire width of the recording medium. In this case, there is an embodiment in which a plurality of ink ejection head modules are combined, each of the modules being relatively short and having a nozzle row that is shorter than the entire width of the recording medium. These modules are connected with each other, and thereby a nozzle row which is, as a whole, as long as the entire width of the recording medium is configured.

The full-line type of ink ejection head is usually disposed along a direction perpendicular to a relative feed direction of the recording medium (relative conveyance direction). However, an embodiment is possible in which the ink ejection head is disposed in an oblique direction with a predetermined angle with respect to the direction perpendicular to the conveyance direction.

The "recording medium" is a medium (medium which can be referred to as a print medium, image formation receiving medium, record receiving medium, image receiving medium, and the like) on which an image is recorded by operation of the ink ejection head. The Examples of the recording medium include resin sheets such as continuous paper, cut paper, seal paper, and OHP sheet, a film, fabric, an intermediate transfer medium, print boards in which a wiring pattern is formed, and other various media regardless of materials or shapes.

The conveyance device which moves the recording medium and the ink ejection head relatively to each other, may be any modes of conveying the recording medium to a suspended (locked) ink ejection head, moving the ink ejection head to a suspended recording medium, or moving both the ink ejection head and the recording medium.

The present invention is also directed to an image forming apparatus, comprising: an ink ejection head having a nozzle row ejecting inks of the plurality of colors; a scanning device by which the ink ejection head is moved relatively to a recording medium so that the ink ejection head scans a recording region on the recording medium a plurality of times; a density information obtaining device which obtains information on $OD_\beta(\alpha)$ concerning the ink of a first color $\alpha$ of the plurality of colors and $OD_\alpha(\beta)$ concerning the ink of a second color $\beta$ of the plurality of colors, where $OD_\beta(\alpha)$ is a reflection density in a range of a color complementary to the second color $\beta$ in a deposition sample obtained when only the ink of the first color $\alpha$ is deposited, and $OD_\alpha(\beta)$ is a reflection density in a range of a color complementary to the first color $\alpha$ in a deposition sample obtained when only the ink of the second color $\beta$ is deposited; a deposition order determination device which determines a deposition order so that one of the inks of the first color $\alpha$ and the second color $\beta$ which one corresponds to smaller one of $OD_\beta(\alpha)$ and $OD_\alpha(\beta)$ is first deposited and the other of the inks of the first color $\alpha$ and the second color $\beta$ is subsequently deposited; and an ejection control device which controls operation of the ink ejection head so that the inks overlap on one another on the recording medium in accordance with the deposition order determined by the deposition order determination device.

The present invention is also directed to an image forming apparatus, comprising: an ink ejection head having a nozzle row ejecting inks of the plurality of colors; a scanning device by which the ink ejection head is moved relatively to a recording medium so that the ink ejection head scans a recording region on the recording medium a plurality of times; a density information obtaining device which obtains information on OD_α(α→β), OD_β(α→β), OD_α(β→α), and OD_β(β→α), where OD_α(α→β) is a reflection den of a color complementary to a first color α in a deposition sample obtained when an ink of a second color β is deposited on an ink of the first color α, OD_β(α→β) is a reflection density in a range of a color complementary to the second color β in the deposition sample obtained when the ink of the second color β is deposited on the ink of the first color α, OD_α(β→α) is a reflection density in the range of the color complementary to the first color α in a deposition sample obtained when the ink of the first color α is deposited on the ink of the second color β, and OD_β(β→α) is a reflection density in the range of the color complementary to the second color β in the deposition sample obtained when the ink of the first color α is deposited on the ink of the second color β; a deposition order determination device which determines a deposition order of the inks of the first color α and the second color β according to values of OD_α(α→β), OD_β(α→β), OD_α(β→α), and OD_β(β→α) obtained by the density information obtaining device; and an ejection control device which controls operation of the ink ejection head so that the inks overlap on one another on the recording medium in accordance with the deposition order determined by the deposition order determination device.

The "density information obtaining device" described above may include a density measuring device which actually ejects ink to form a sample and measure the reflection density thereof, or may be a user interface using an input apparatus typified by an operation button, keyboard, mouse, touch panel and the like, a communication interface, or a combination of them.

It should be noted that these aspects of the present invention are preferable in a shuttle scan (multi-pass) type image forming apparatus, which can appropriately control deposition orders.

According to the present invention, the deposition order in which reproduction of higher density is possible is determined on the basis of the spectral characteristics of inks, and thus an image with high color reproductiveness can be formed under the conditions that the same ink is used and the same amount of droplets is deposited, in comparison with the related art.

BRIEF DESCRIPTION OF THE DRAWINGS

The nature of the present invention, as well as other objects and benefits thereof, are explained in the following with reference to the accompanying drawings, wherein:

FIG. 3 is a table showing deposition orders which are determined for three color inks, C, M, and Y;

FIG. 7 is a table showing deposition orders, which are determined for the three color inks, C, M, and Y;

DETAILED DESCRIPTION OF THE PREFERRED EMBODIMENTS

First Embodiment

Method for Determining Deposition Order from Reflection Density of Single Color A method for determining a deposition order from a reflection density of a single color for three inks, cyan (C), magenta (M), and yellow (Y), is based on the following procedures (procedure 1-1) through (procedure 1-3).

(Procedure 1-1)

The reflection densities in the ranges of red (R), green (G), and blue (B) for single color for the inks C, M, and Y, in other words the reflection densities concerning C wavelength range, M wavelength range, and Y wavelength range, are measured respectively. The measured reflection densities in this case are reflection densities that are obtained by performing deposition at the maximum density (maximum recording resolution) where the deposition is possible. It should be noted that "reflection density" is defined by three-color density, which is normally used, and status A is used as spectral sensitivity. These definitions are based on "ISO 5/3-1984: Photography-Density Measurements-Part 3: Spectral conditions".

(Procedure 1-2)

The magnitudes of the reflection densities concerning the wavelength ranges of two colors, which are randomly selected from among C, M, and Y, are compared with each other. For example, when the C ink and the M ink are selected, then the magnitude of the reflection density in the M wavelength range concerning the C ink is compared with the magnitude of the reflection density in the C wavelength range concerning the M ink.

Figure 21A:
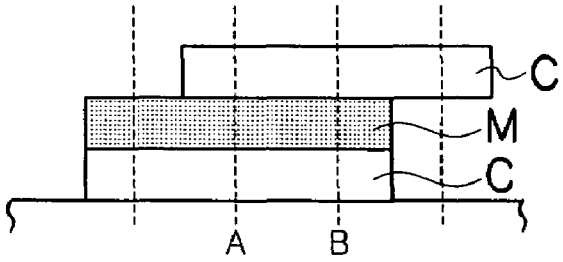
FIGS. 21A and 21B are cross sectional views schematically showing a state in which ink is deposited on pixels A and B which are adjacent to each other on a recording medium.
Figure 21B:
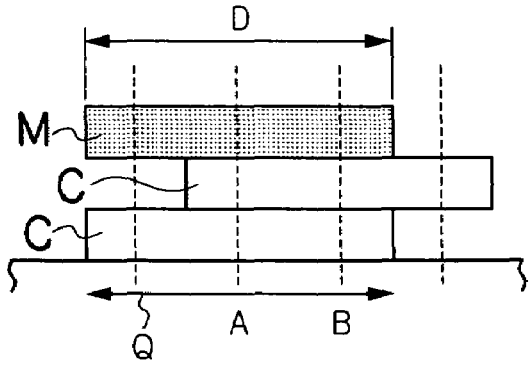
Figure 22:
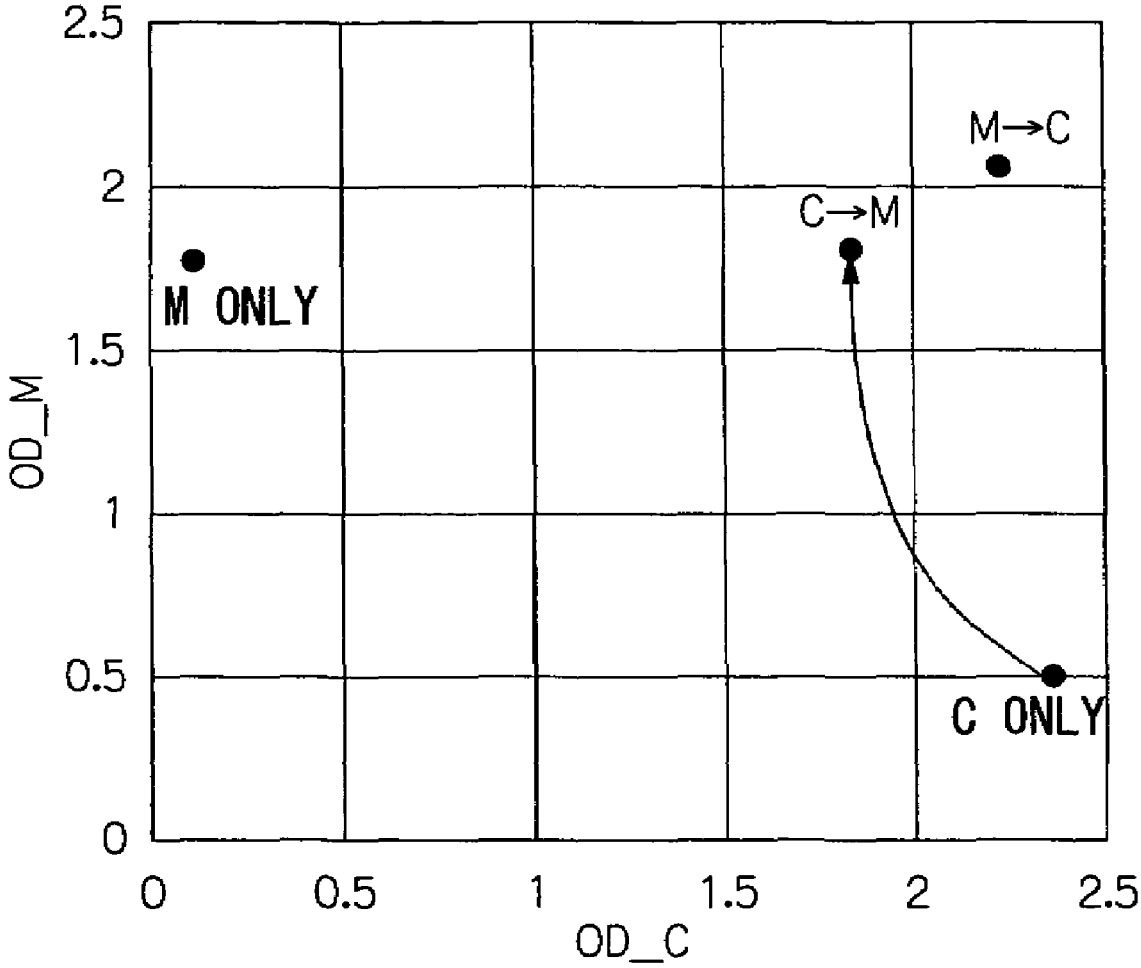
FIG. 22 is a graph showing a density measurement result of a single color sample of each of cyan (C) and magenta (M) and that of a sample of the two colors overlapping with each other.

As described with reference to FIGS. 21A and 21B, if the ink α is first deposited when the relation of OD_β(α)>OD_α(β) is satisfied, then, as the ink β overlaps on the ink α more and more, light of the α wavelength range is more reflected at the outermost surface of the ink, and whereby the density concerning α is reduced. In this case, therefore, the deposition is performed in the order of ink β to ink α (β→α). For example, an example of comparison between the C ink and the M ink is shown in FIG. 1.

Figure 1:
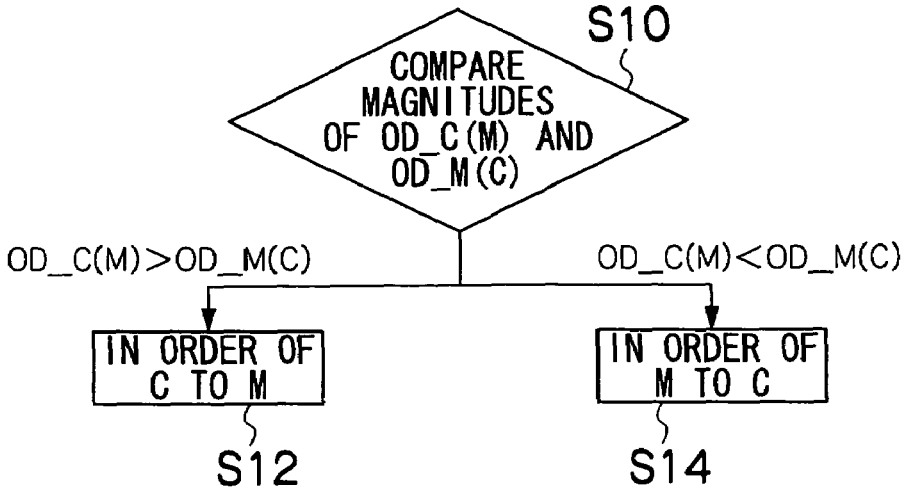
FIG. 1 is a flowchart showing an example of the method for determining a deposition order according to the reflection density of a single color.

As shown in FIG. 1, the magnitude of the reflection density OD_M (C) in the M wavelength range concerning the C ink is compared to the magnitude of the reflection density OD_C (M) in the C wavelength range concerning the M ink (step S10). If the relation of OD_C (M)>OD_M (C) is satisfied, the deposition is performed in the order of C ink to M ink (step S12). On the other hand, if the relation of OD_C (M)<OD_M (C) is satisfied in the determination in step S10, then the deposition is performed in the order of M ink to C ink (step S14).

Figure 2A:
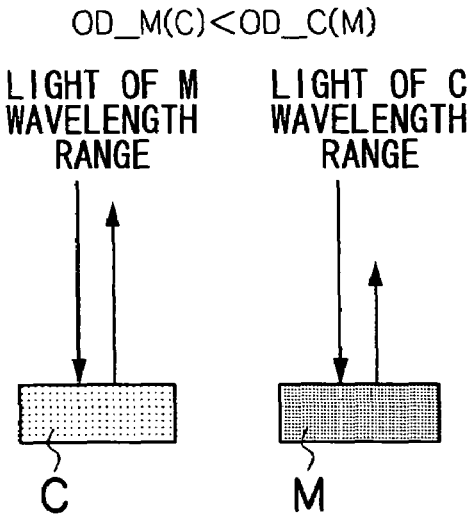
FIGS. 2A and 2B are schematic diagrams showing a state in which cyan (C) ink and magenta (M) ink reflect light.
Figure 2B:
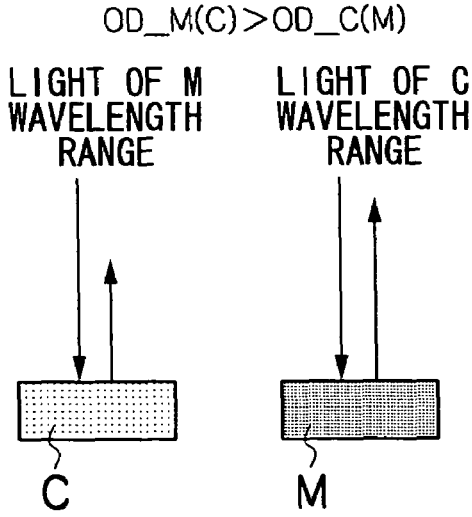

FIG. 2A is a schematic diagram showing reflection when the relation of OD_M (C)<OD_C (M) is satisfied, and FIG. 2B is a schematic diagram showing reflection when the relation of OD_M (C)>OD_C (M) is satisfied. The reference characters C and M respectively indicate inks of cyan (C) and magenta (M) which are deposited on the recording medium, and the lengths of the arrows from the C ink and the M ink indicate the luminous energy of the reflected light.

Deposition orders for a combination of two colors other than the combination of the C ink and M ink ("M and Y", "Y and C") can be determined in the same manner as the combination of the C ink and M ink.

When a deposition order for each of the combinations of C and M, M and Y, and Y and C is determined, eight combinations ((a) to (h)) are obtained as shown in the table of FIG. 3. For the cases (b) to (g) in this table, the deposition orders of C, M, and Y (the arrangement orders of the heads of the colors when the single pulse type image forming apparatus is used) are determined uniquely as shown in the table.

However, in the cases of (a) and (h) shown in the table of FIG. 3, the deposition orders determined for the combinations of C and M, M and Y, and Y and C have the relation of so-called "three-cornered deadlock", and thus deposition order of C, M and Y can not be uniquely determined in the above-mentioned method. In these cases, the deposition order is determined according to a method shown below (procedure 1-3).

(Procedure 1-3)

In the case of the "three-cornered deadlock" described above, of the three inequalities used in the evaluation, the deposition order is determined according to the result of the top two inequalities in which the differences are larger. For convenience of expression, "OD_α(β)−OD_β(α)" is described as Δ(αβ) (i.e., OD_α(β)−OD_β(α)=Δ(αβ)). For example, in (a) in the table of the FIG. 3, if the differences Δ(CM), Δ(MY), and Δ(YC) between the left-hand sides and the right-hand sides in the inequalities of the combinations (C and M, M and Y, and Y and C) are expressed as Δ(CM)>Δ(MY)>Δ(YC), then the results of the top-two combinations, that is, C and M, M and Y, of which the differences between the left-hand sides and the right-hand sides in the inequalities are larger, are employed (i.e., the result of the combination of Y and C of which the difference is the smallest is ignored), and the deposition order is determined so that the inks are ejected and deposited in the order of C, M, and Y from the bottom (from the side close to the recording medium).

Figure 4:
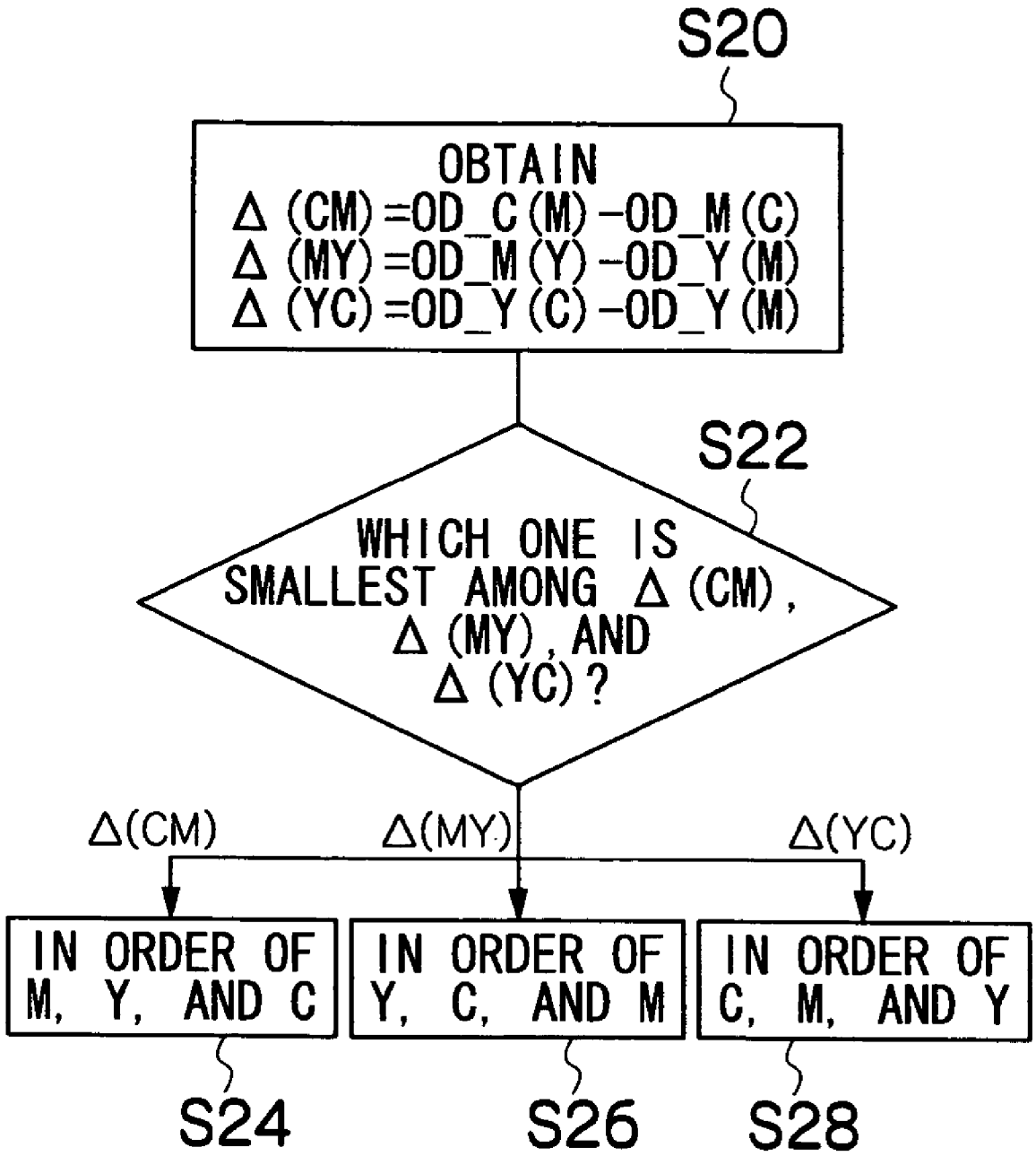
FIG. 4 is a flowchart showing procedures for determining a deposition order for the case shown in (a) in FIG. 3.

For example, in the case of (a) in the table, a flow for determination of the deposition order is shown in FIG. 4. As shown in FIG. 4, first of all, Δ(CM), Δ(MY) and Δ(YC) are obtained (step S20), and then the smallest difference from among the above differences is determined (step S22). If Δ(CM) is determined as the smallest one in step S22, the result of the combination of C and M is ignored to employ the results of the rest of the two combinations, and the deposition order is set to be the order of M, Y, and C (step S24). If Δ(MY) is determined as the smallest one in step S22, the result of the combination of M and Y is ignored to employ the results of the rest of the two combinations, and the deposition order is set to be the order of Y, C, and M (step S26). If Δ(YC) is determined as the smallest one in step S22, the result of the combination of Y and C is ignored to employ the results of the rest of the two combinations, and the deposition order is set to be the order of C, M, and Y (step S28).

It should be noted that the deposition order of black is not particularly limited in the present invention.

As described above, in the reflection densities concerning single colors, a color material with large reflection density in a wavelength range corresponding to another color is subsequently ejected and deposited. In the case of the single pulse type inkjet recording apparatus, regarding the alignment order of the CMY heads, a head for ejecting a color material having large reflection density for single color in a wavelength range corresponding to other color is disposed after a head for ejecting a color material having the small reflection density (in downstream side). Accordingly, in comparison with the related art, an image with higher density (higher color reproductiveness) can be formed under the conditions that the same ink is used and the same amount of droplets is deposited.

Second Embodiment

Method for Determining Deposition Order from Reflection Density of Secondary Color Obtained by Depositing to Make Overlaps Concerning three inks, cyan (C), magenta (M), and yellow (Y), a method for determining a deposition order according to the reflection density of a secondary color in depositing two colors to overlap on each other is based on the following procedures (procedure 2-1) through (procedure 2-3).

(Procedure 2-1)

For any two color inks (these inks are indicated as α and β) of the inks C, M, and Y, the reflection density (α wavelength range and β wavelength range) of a sample obtained by depositing the inks in the order of α to β (α→β), and the reflection density (α wavelength range and β wavelength range) of a sample obtained by depositing the inks in the order of β to α are measured. The amount of ink deposition per unit area for each sample is ½ (half) of the supposed maximum deposition amount for a unit area.

(Procedure 2-2)

For the values obtained in the above procedure 2-1, when plotting is performed by applying the density in the a wavelength range (OD_α) to the horizontal axis and applying the density in the β wavelength range (OD_β) to the vertical axis, then the relative positional relationship therebetween is any of FIGS. 5A through 5D. A black circle in the figures indicates a measured value of the sample obtained by depositing in the order of α to β, and a black triangle indicates a measured value of the sample obtained by depositing in the order of β to α.

Figure 5A:
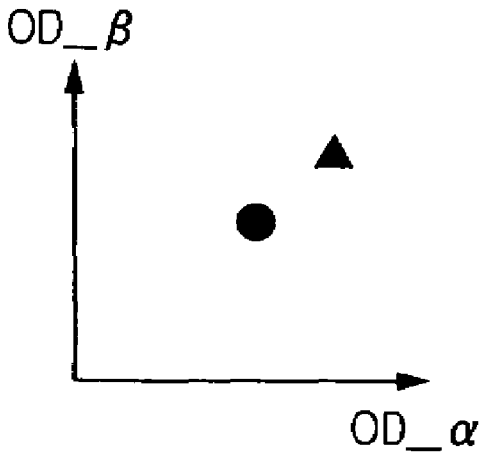
FIGS. 5A to 5D shows the relative positional relationship between the density in an α range and the density in a β range, depending on the difference in the deposition orders obtained in determination of a deposition order according to the reflection density of a secondary color.

In the case of FIG. 5A, both of the densities in the α wavelength range and the β wavelength range obtained by performing the deposition in the order of β to α are larger than those obtained by performing the deposition in the order of α to β. In this case, therefore, the deposition is performed in the order of β to α.

Figure 5B:
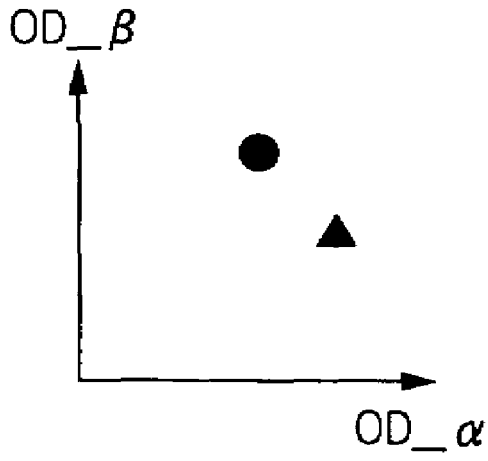
Figure 5C:
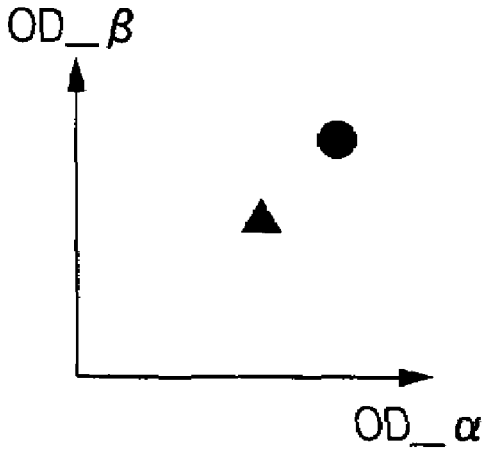

In the case of FIG. 5C, the deposition is performed in the order of α to β because of the same reason as the case shown in FIG. 5A.

In the case of FIG. 5B, the density of the color that corresponds to the ink deposited first (the ink deposited below) are smaller. In this case, the droplet deposition is performed according to the change values (deducted values) of the densities. The term "change value (deducted value) of the densities" here means the difference (deduction) between the density in the case of the ink being deposited below (a plurality of colors of inks being deposited) and the density in the case of the single color ink (α only or β only) being deposited. In the present embodiment, the ink having the smaller change value (deducted value) of the densities is first ejected and deposited. For example, when the following relation $$OD_\alpha(\alpha)-OD_\alpha(\alpha\rightarrow\beta)>OD_\beta(\beta)-OD_\beta(\beta\rightarrow\alpha)$$

is established, then the droplet deposition is performed in the order of β to α (β→α).

Figure 5D:
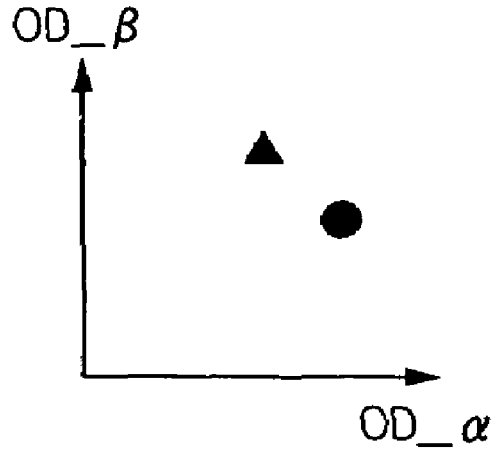

In the case of FIG. 5D, the density of the color corresponding to the ink which is subsequently deposited (the ink deposited above) is smaller. This situation is normally unlikely. However, if such situation occurs, then the droplet deposition is performed according to the change values (deducted values) of the densities, which mean the differences (deductions) between the density in the case of the ink being deposited below and the density in the case of the single color ink (α only or β only) being deposited. In the present embodiment, the ink having the smaller change value (deducted value) of the densities is first ejected and deposited. For example, when the following relation $$OD_\alpha(\alpha)-OD_\alpha(\beta\rightarrow\alpha)>OD_\beta(\beta)-OD_\beta(\alpha\rightarrow\beta)$$

is established, then the droplet deposition is performed in the order of α to β (α→β). For example, the flow chart of the deposition order determination in the case of the C (cyan) and M (magenta) is shown in FIG. 6.

Figure 6:
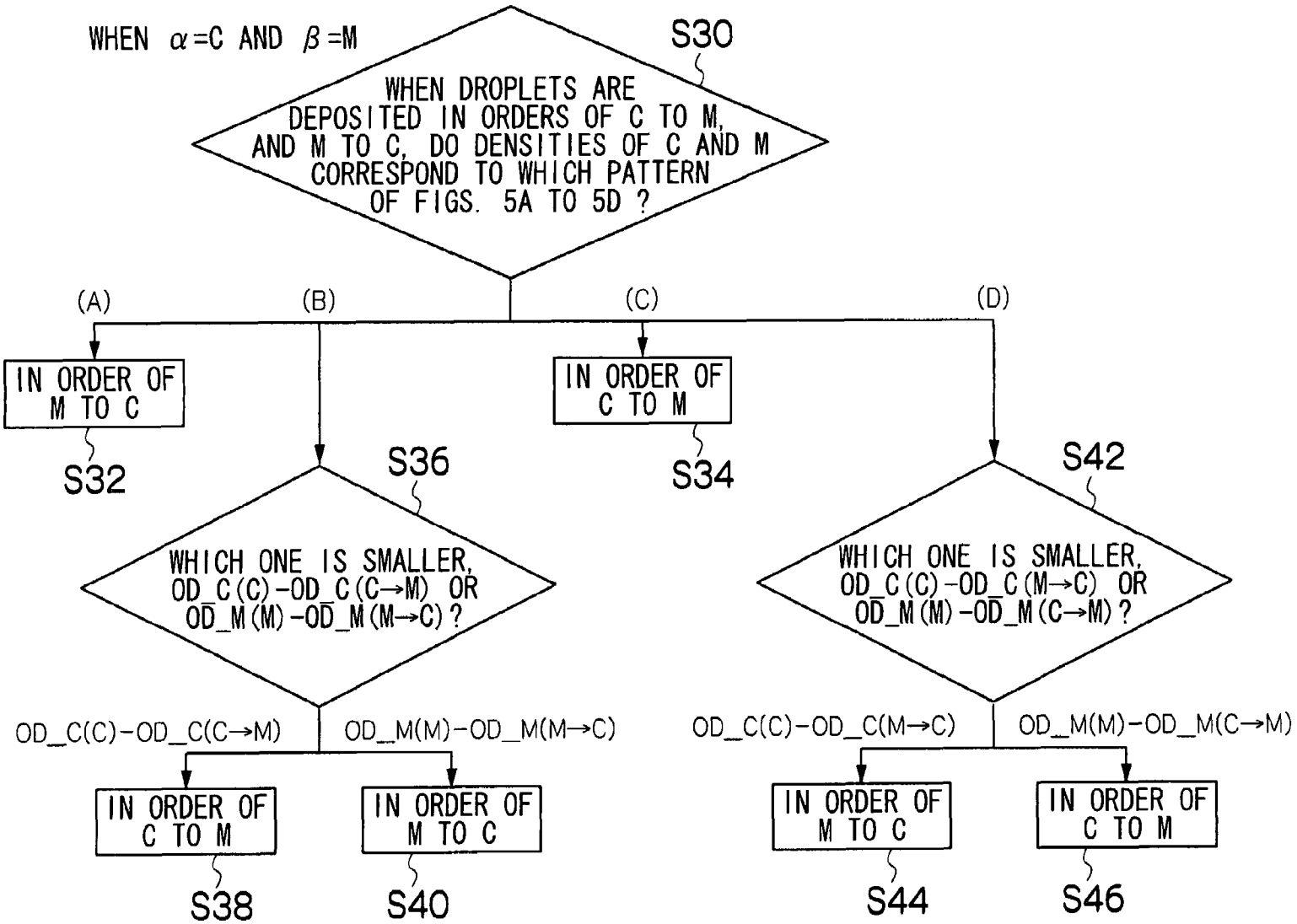
FIG. 6 is a flowchart showing procedures for determining a deposition order of the two colors C and M.

As shown in FIG. 6, it is determined whether the densities of C and M in the cases of depositing the inks in the orders of C to M and M to C correspond to any of the patterns shown in FIGS. 5A through 5D (step S30). If it is determined in step S30 that the densities of C and M correspond to the pattern (A), then the ejection and deposition is performed in the order of M to C (M→C) (step S32). If it is determined in step S30 that the densities of C and M correspond to the pattern (C), then the ejection and deposition is performed in the order of C to M (C→M) (step S34).

If it is determined in step S30 that the densities of C and M correspond to pattern (B), then the step proceeds to step S36. In step S36, the magnitude relationship between "OD_C (C)−OD_C(C→M)" and "OD_M(M)−OD_M (M→C)" is measured, and the smaller one is determined. If it is determined in step S36 that "OD_C(C)−OD_C(C→M)" is smaller, then the ejection and deposition is performed in the order of C to M (step S38). If it is determined in step S36 that "OD_M (M)−OD_M(M→C)" is smaller, then the ejection and deposition is performed in the order of M to C (step S40).

If it is determined in step S30 that the densities of C and M correspond to pattern (D), then the step proceeds to step S42. In step S42, the magnitude relationship between "OD_C (C)−OD_C(M→C)" and "OD_M(M)−OD_M (C→M)" is measured, and the smaller one is determined. If it is determined in step S42 that "OD_C(C)−OD_C(M→C)" is smaller, then the ejection and deposition is performed in the order of M to C (step S44). If it is determined in step S42 that "OD_M (M)−OD_M(C→M)" is smaller, then the ejection and deposition is performed in the order of C to M (step S46).

(Procedure 2-3)

The above-described procedures 2-1 and 2-2 are performed for each of the combinations, C and M, M and Y, and Y and C, and the deposition orders for C and M, M and Y, and Y and C are determined. As a result, eight possible droplet deposition orders ((a) to (h)) are obtained as shown in the table of FIG. 7.

When a deposition order of the three colors is uniquely determined (in the case of (b) to (g) shown in the table of FIG. 7), the droplet deposition is performed according to the determined order.

(Procedure 2-4)

When a deposition order is not uniquely determined as in (a) and (h) shown in the table of FIG. 7 (in the case of so-called "three-cornered deadlock"), the droplet deposition order is determined by ignoring a result of one of the three combinations. In this case, the results of two combinations in which the change values (deducted values) between the density in the case of depositing in the order determined in procedure 2-3 and the density in the case of depositing in reverse order of the deposition order determined in procedure 2-3 is larger than that of the other combination, is employed. For example, in the case of (a) in FIG. 7, the droplet deposition order is determined according to the following procedures (1) through (3).

It should be noted that "OD_α(α→β)−OD_α(β→α)" is described as "ΔOD_α(αβ)" (i.e., ΔOD_α(αβ)=OD_α (α→β)−OD_α(β→α)). Combinations of the two colors here are (α, β)=(C, M), (M, Y), or (Y. C).

(1) First, values of ΔOD_C(CM), ΔOD_M(CM), ΔOD_M (MY), ΔOD_Y(MY), ΔOD_Y(YC), and ΔOD_C(YC) are obtained.

(2) Next, the larger value of ΔOD_C(CM) and ΔOD_M (CM) is obtained and expressed as ΔOD(CM), the larger value of ΔOD_M(MY) and ΔOD_Y(MY) is obtained and expressed as ΔOD(MY), and the larger value of ΔOD_Y (YC) and ΔOD_C(YC) is obtained and expressed as ΔOD(YC).

(3) Results of two combinations which correspond to two larger values of ΔOD (CM), ΔOD (MY), and ΔOD (YC) obtained in (2) are employed. For example, if the following relation $$\Delta OD(CM)>\Delta OD(MY)>\Delta OD(YC)$$

is established, then the droplet deposition is performed in the order of C, M, and Y, in consideration of the deposition order of C and M, and M and Y.

Figure 8:
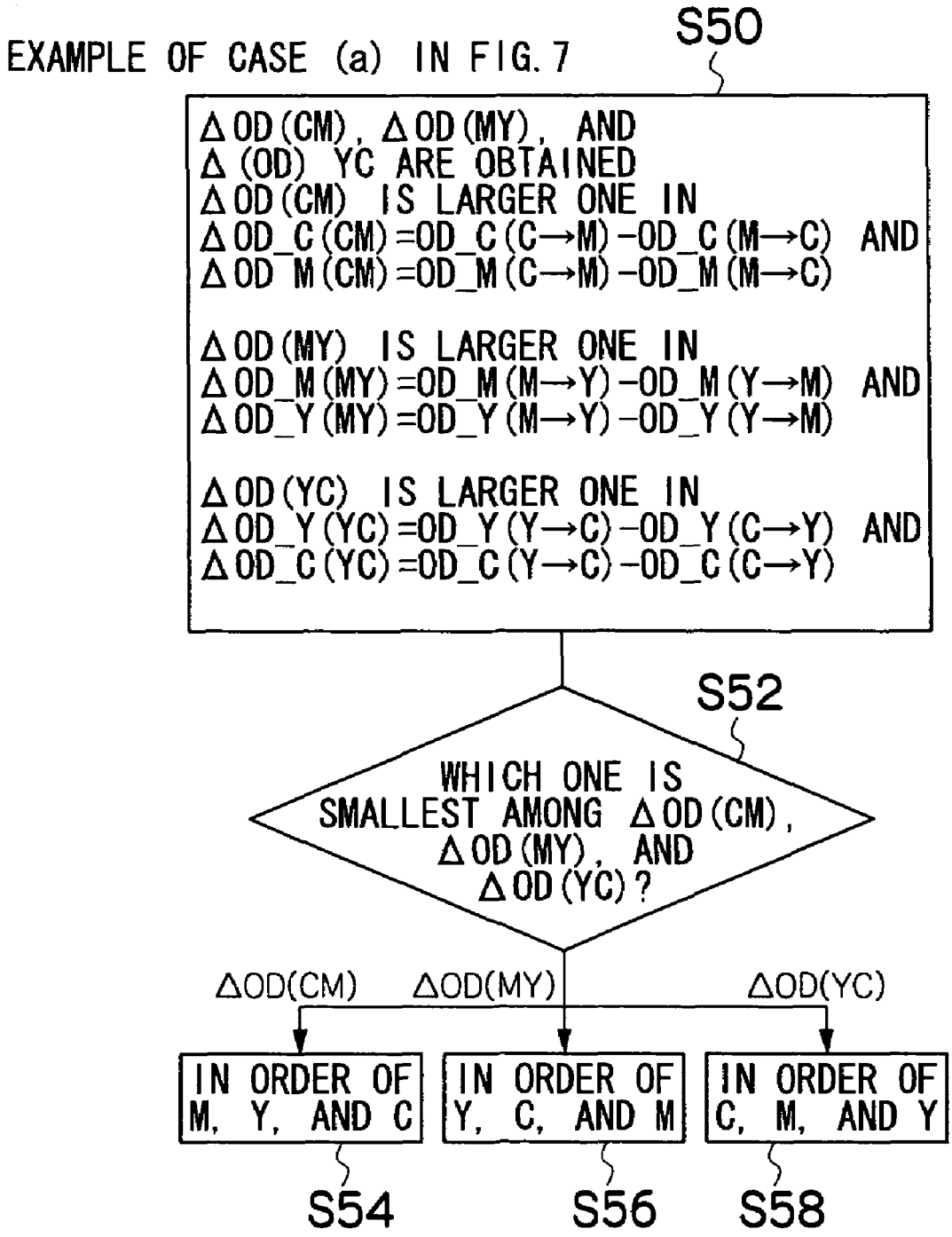
FIG. 8 is a flowchart showing procedures for determining a deposition order for the case shown in (a) in FIG. 7.

The flow chart of deposition order determination for the case (a) in FIG. 7 is shown in FIG. 8.

As shown in FIG. 8, first, ΔOD(CM), ΔOD(MY), and ΔOD(YC) are obtained (step S50), and the smallest one among them is determined (step S52). If ΔOD (CM) is the smallest one, the deposition orders of other top two combinations are prioritized to perform the droplet deposition in the order of M, Y, and C (step S54). In the determination of step S52, if ΔOD(MY) is the smallest one, the deposition orders of other top two combinations are prioritized to perform the droplet deposition in the order of Y, C, and M (step S56). In the determination of step S52, if ΔOD(YC) is the smallest one, the deposition orders of other top two combinations are prioritized to perform the droplet deposition in the order of C, M, and Y (step S58).

In the case of (h) in FIG. 7, the same processing as the case shown in the above-mentioned (a) can be employed. It should be noted that the deposition order of black is not particularly limited in the present invention.

As described above, for a combination of any two colors of CMY, a deposition order (overlapping order) of the inks is determined so as to obtain larger density when the inks overlap on each other.

In the case of the single pulse type inkjet recording apparatus, the arrangement order of the heads is designed according to the deposition order determined in accordance with the above-mentioned method. Specifically, the heads of colors are disposed in accordance with the order of deposition of the colors, from the upstream side toward the downstream side with respect to the conveyance direction of the recording paper. Accordingly, in comparison with the related art, an image with higher density (higher color reproductiveness) can be formed under the conditions that the same ink is used and the same amount of droplets is deposited.

The deposition order determined in the above-described method is not limited to the case applied to the single pulse type of the inkjet recording apparatus, and can be applied to a shuttle scan type of the inkjet recording apparatus.

The method of the color ink droplet deposition order determination of each embodiment described above can be carried out using a computer. Specifically, a program for allowing a computer to execute the algorithm of the method of the color ink droplet deposition order determination (deposition order determination processing program) is created, and the computer can be operated according to this program. In this way, the computer can be made to serve as a color ink deposition order determination apparatus.

Figure 9:
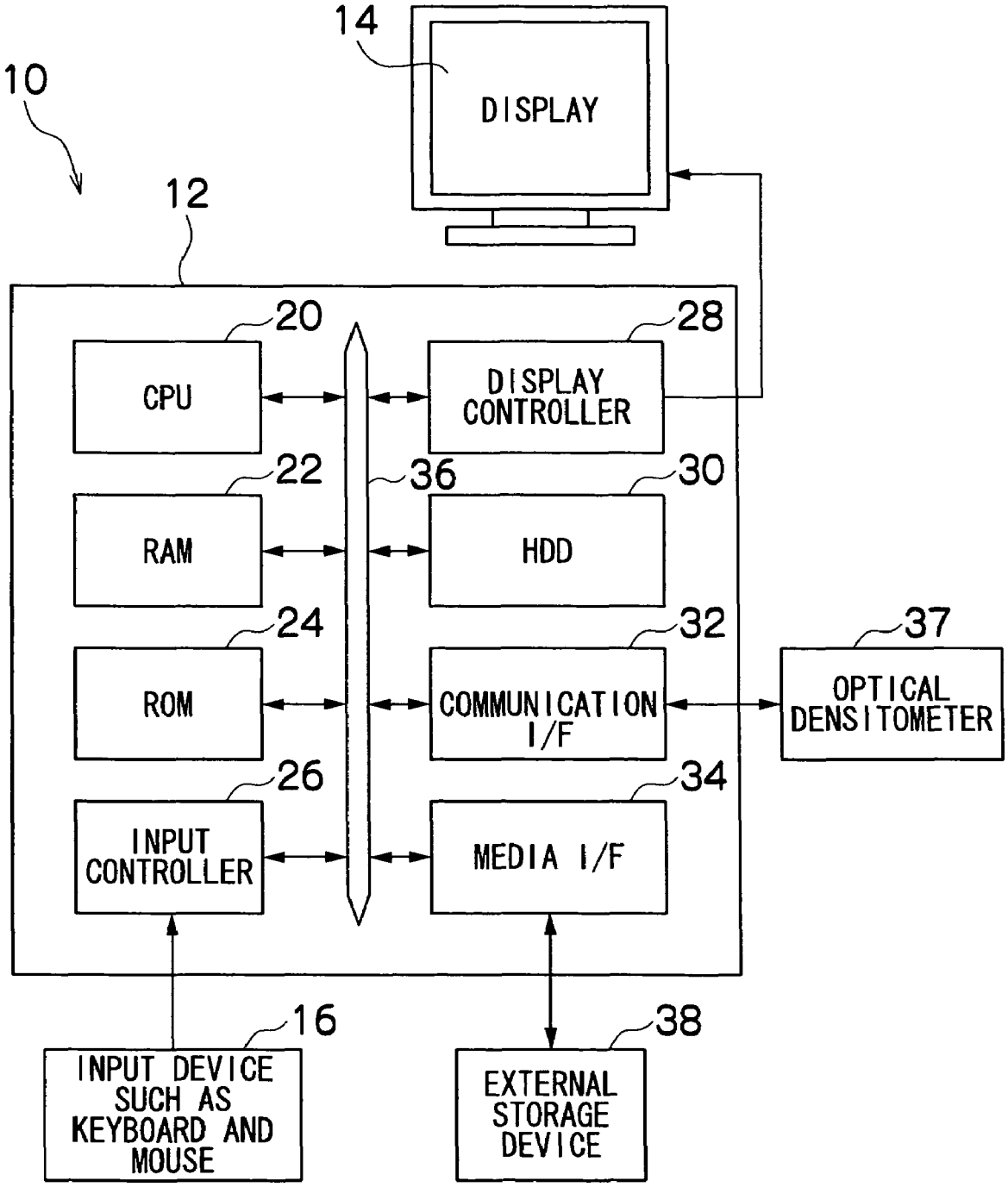
FIG. 9 is a block diagram showing a configuration diagram of a system of a computer.

FIG. 9 is a block diagram showing a configuration diagram of a system of a computer. A computer 10 includes a main body 12, a display (display device) 14, and an input apparatus (input device for input of various instructions) 16 such as a keyboard and mouse. The main body 12 has therein a central processing unit (CPU) 20, RAM 22, ROM 24, an input controller 26 which controls signal input from the input apparatus 16, a display controller 28 which outputs a display signal to the display 14, a hard disk apparatus 30, a communication interface 32, and a media interface 34. These circuits are connected to one another via a bus 36.

The CPU 20 functions as the entire control apparatus and a computing apparatus. The RAM 22 is used as a storage region for storing data temporarily, or an operation region in executing a program by the CPU 20. The ROM 24 is a nonvolatile rewritable-storage-device on which a boot program for allowing the CPU 20 to operate, various setting values, and network connection information are stored. An operating system (OS), various application software (programs), data, and so on are stored on the hard disk apparatus 30.

The communication interface 32 is a device connected to an external equipment or communication network according to a predetermined transmission method such as USB, LAN, or Bluetooth. In the present embodiment, an optical densitometer 37 can be connected to the communication interface 32 via the communication interface 32. The optical densitometer 37 measures reflection density of a deposition sample, and outputs data on the measured value. The media interface 34 is a device performing read/write control of an external storage apparatus 38 as typified by a memory card, a magnetic disk, a magneto-optical disk, and an optical disk.

The information on the reflection density of a single color ink or the information on the reflection density of the secondary color may be obtained by actually measuring the reflection density by means of the optical densitometer 37, obtained by inputting a value obtained previously by experiments or the like via the input apparatus 16, or obtained via the communication interface 32 or media interface 34.

The program for the color ink deposition order determination processing according to the present embodiment is stored in the hard disk apparatus 30 or the external storage apparatus 38. The program is read out according to need, opened up on the RAM 22, and then executed. Alternatively, an embodiment is possible in which the program is provided by a server installed on a network (not shown) which is connected via the communication interface 32, and an embodiment is possible in which a computation service according to the program is provided by a server on the Internet.

An operator can operate the input apparatus 16 while viewing an application window (not shown) which is displayed on the display 14, input the setting conditions such as computation conditions and initial values, and confirm computation results on the display 14.

An example of the inkjet recording apparatus that is designed by using the result of the deposition order determined by the method of the color ink deposition order determination according to the present embodiment, is described below.

Entire Configuration of Inkjet Recording Apparatus

Figure 10:
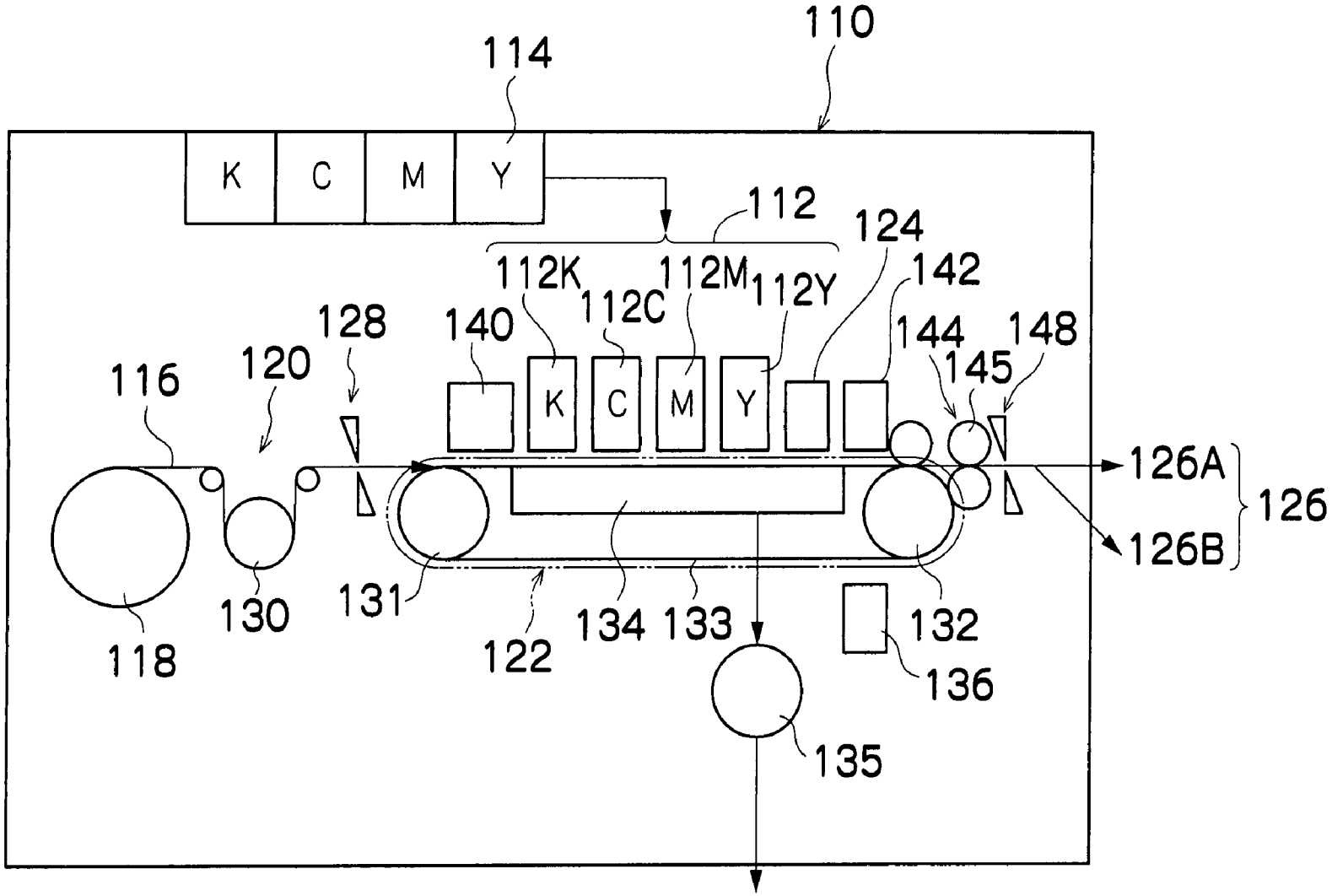
FIG. 10 is the entire configuration diagram of an inkjet recording apparatus which shows an embodiment of the image forming apparatus according to the present invention.

FIG. 10 is the entire configuration diagram of the inkjet recording apparatus that shows an embodiment of the image forming apparatus according to the present invention. This section describes an example of the apparatus that is designed on the basis of a determination result indicating that droplet deposition should be performed in the order of C, M, and Y. As shown in FIG. 10, the inkjet recording apparatus 110 comprises: a printing unit 112 having a plurality of inkjet recording heads (hereafter, called "heads") 112K, 112C, 112M, and 112Y provided for ink colors of black (K), cyan (C), magenta (M), and yellow (Y), respectively; an ink storing and loading unit 114 for storing inks of K, C, M and Y to be supplied to the print heads 112K, 112C, 112M, and 112Y; a paper supply unit 118 for supplying recording paper 116 which is a recording medium; a decurling unit 120 removing curl in the recording paper 116; a belt conveyance unit 122 disposed facing the nozzle face (ink-ejection face) of the printing unit 112, for conveying the recording paper 116 while keeping the recording paper 116 flat; a print determination unit 124 for reading the printed result produced by the printing unit 112; and a paper output unit 126 for outputting image-printed recording paper (printed matter) to the exterior.

The ink storing and loading unit 114 has ink tanks for storing the inks of K, C, M, and Y to be supplied to the heads 112K, 112C, 112M, and 112Y, and the tanks are connected to the heads 112K, 112C, 112M, and 112Y by means of prescribed channels. The ink storing and loading unit 114 has a warning device (for example, a display device or an alarm sound generator) for warning when the remaining amount of any ink is low, and has a mechanism for preventing loading errors among the colors.

In FIG. 10, a magazine for rolled paper (continuous paper) is shown as an example of the paper supply unit 118; however, another magazine with paper differences in paper width, paper quality, or the like may be jointly provided. Moreover, papers may be supplied with cassettes that contain cut papers loaded in layers and that are used jointly or in lieu of the magazine for rolled paper.

In the case of a configuration in which a plurality of types of recording medium (medium) can be used, it is preferable that an information recording medium such as a bar code and a wireless tag containing information about the type of medium is attached to the magazine, and by reading the information contained in the information recording medium with a predetermined reading device, the type of recording medium to be used (type of medium) is automatically determined, and ink ejection operation is controlled so that the ink droplets are ejected in an appropriate manner in accordance with the type of medium.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of the configuration in which roll paper is used, a cutter (first cutter) 128 is provided as shown in FIG. 10, and the continuous paper is cut into a desired size by the cutter 128. When cut papers are used, the cutter 128 is not required.

The decurled and cut recording paper 116 is delivered to the belt conveyance unit 122. The belt conveyance unit 122 has a configuration in which an endless belt 133 is set around rollers 131 and 132 so that the portion of the endless belt 133 facing at least the nozzle face of the printing unit 112 and the sensor face of the print determination unit 124 forms a horizontal plane (flat plane).

The belt 133 has a width that is greater than the width of the recording paper 116, and a plurality of suction apertures (not shown) are formed on the belt surface. A suction chamber 134 is disposed in a position facing the sensor surface of the print determination unit 124 and the nozzle surface of the printing unit 112 on the interior side of the belt 133, which is set around the rollers 131 and 132, as shown in FIG. 10. The suction chamber 134 provides suction with a fan 135 to generate a negative pressure, and the recording paper 116 is held on the belt 133 by suction. It should be noted that electrostatic suction may be employed instead of vacuum suction.

The belt 133 is driven in the clockwise direction in FIG. 10 by the motive force of a motor 188 (shown in FIG. 15) being transmitted to at least one of the rollers 131 and 132, which the belt 133 is set around, and the recording paper 116 held on the belt 133 is conveyed from left to right in FIG. 10.

Since ink adheres to the belt 133 when a marginless print job or the like is performed, a belt-cleaning unit 136 is disposed in a predetermined position (a suitable position outside the printing area) on the exterior side of the belt 133. Although the details of the configuration of the belt-cleaning unit 136 are not shown, examples thereof include a configuration in which the belt 133 is nipped with cleaning rollers such as a brush roller and a water absorbent roller, an air blow configuration in which clean air is blown onto the belt 133, or a combination of these. In the case of the configuration in which the belt 133 is nipped with the cleaning rollers, it is preferable to make the line velocity of the cleaning rollers different than that of the belt 133 to improve the cleaning effect.

The inkjet recording apparatus 110 can comprise a roller nip conveyance mechanism, in which the recording paper 116 is pinched and conveyed with nip rollers, instead of the belt conveyance unit 122. However, there is a possibility in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 140 is disposed on the upstream side of the printing unit 112 in the conveyance pathway formed by the belt conveyance unit 122. The heating fan 140 blows heated air onto the recording paper 116 to heat the recording paper 116 immediately before printing so that the ink deposited on the recording paper 116 dries more easily.

Figure 11:
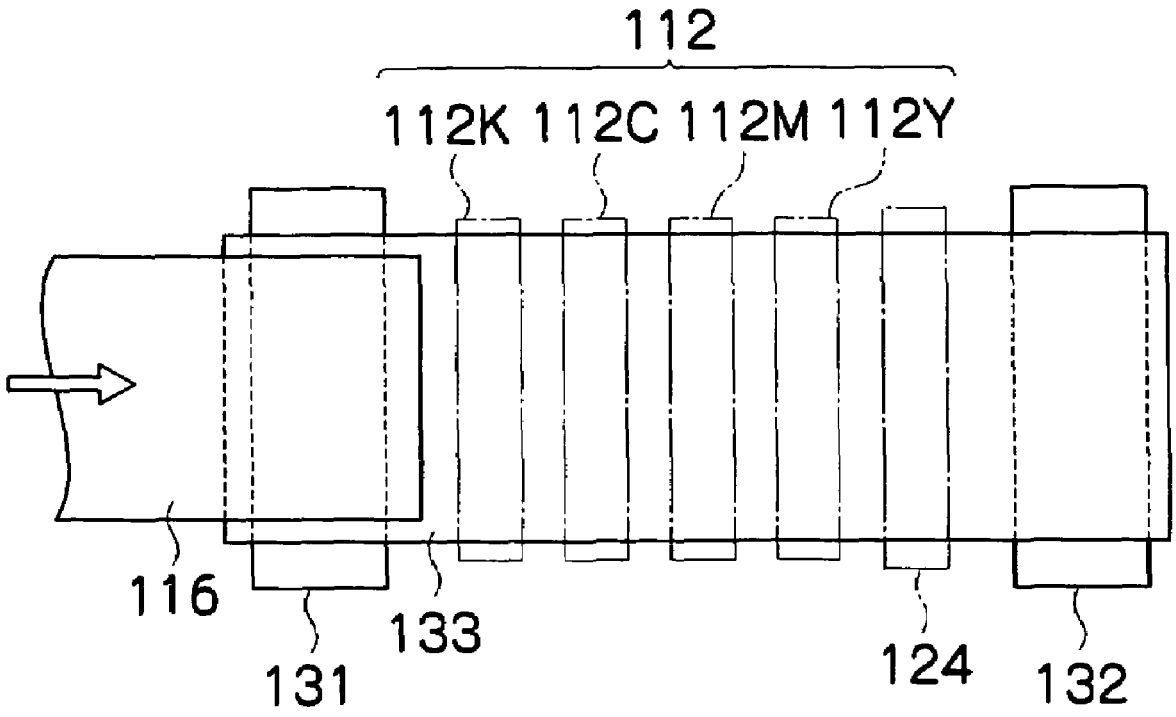
FIG. 11 is a planar view showing substantial parts in the vicinity of a print unit of the inkjet recording apparatus shown in FIG. 10.

The heads 112K, 112C, 112M and 112Y of the printing unit 112 are full line heads having a length corresponding to the maximum width of the recording paper 116 used with the inkjet recording apparatus 110, and comprising a plurality of nozzles for ejecting ink arranged on a nozzle face through a length exceeding at least one edge of the maximum-size recording medium (namely, the full width of the printable range) (see FIG. 11).

The print heads 112K, 112C, 112M and 112Y are arranged in color order (black (K), cyan (C), magenta (M), yellow (Y)) from the upstream side in the feed direction of the recording paper 116, and these respective heads 112K, 112C, 112M and 112Y are fixed extending in a direction substantially perpendicular to the conveyance direction of the recording paper 116.

A color image can be formed on the recording paper 116 by ejecting inks of different colors from the heads 112K, 112C, 112M and 112Y, respectively, while the recording paper 116 is conveyed by the belt conveyance unit 122.

By adopting a configuration in which the full line heads 112K, 112C, 112M and 112Y having nozzle rows covering the full paper width are provided for the respective colors in this way, it is possible to record an image on the full surface of the recording paper 116 by performing just one operation of relative movement of the recording paper 116 and the printing unit 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Moreover, the deposition order of the heads of colors is based on the determination result obtained in the color ink deposition order determination methods that are described with reference to FIGS. 1 through 9.

The print determination unit 124 shown in FIG. 10 has an image sensor (line sensor or area sensor) for capturing an image of an ejection result of the print unit 112, and functions as a device to check for ejection defects such as blockage in the nozzles and displacement of the deposition positions according to the formed image which is evaluated by the image sensor. The print determination unit 124 reads a test pattern or an actual image that is printed with the heads 112K, 112C, 112M, and 112Y for the colors, and the ejection of each head is determined. The ejection determination includes the presence of the ejection, measurement of the dot size, and measurement of the dot deposition position. In addition, the print determination unit 124 can be used as a device for measuring optical density of a deposition sample.

A post-drying unit 142 is disposed following the print determination unit 124. The post-drying unit 142 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated. The uneven shape is transferred to the image surface.

The printed matter generated in this manner is outputted from the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not shown in FIG. 10, the paper output unit 126A for the target prints is provided with a sorter for collecting prints according to print orders.

Structure of Head

Next, the structure of a head is described below. The heads 112K, 112C, 112M, and 112Y of the respective ink colors have the same structure, and a reference numeral 150 is hereinafter designated to any of the heads.

Figure 12A:
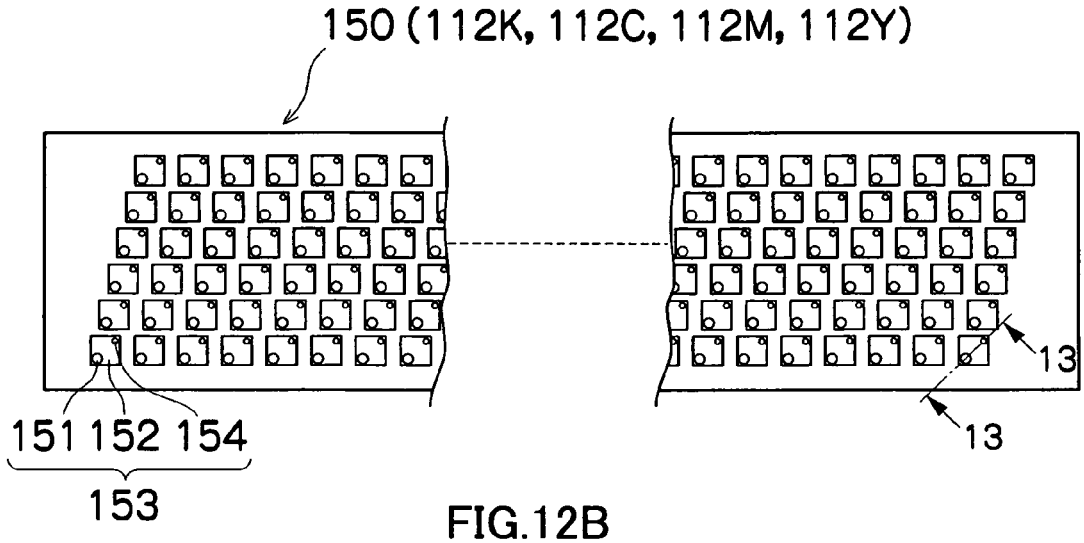
FIG. 12A is a planar perspective view showing a constructional example of a head.
Figure 12B:
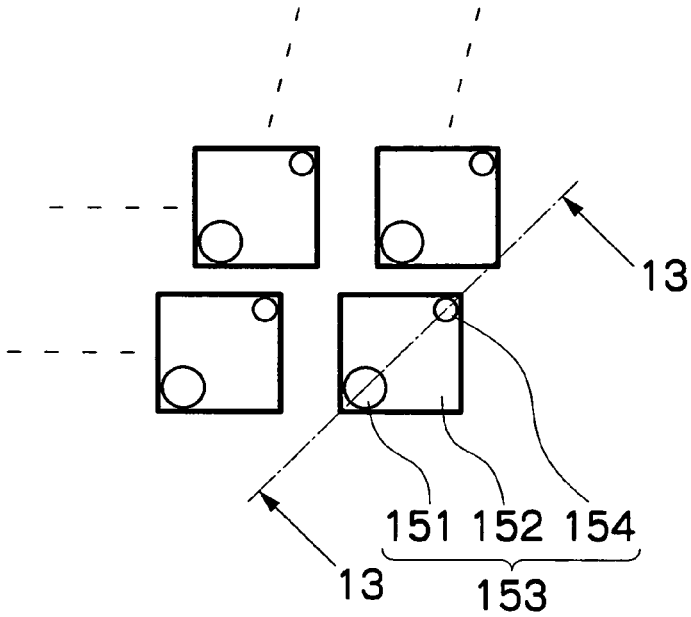
FIG. 12B is a view of enlarged substantial parts of the head shown in FIG. 12A.
Figure 12C:
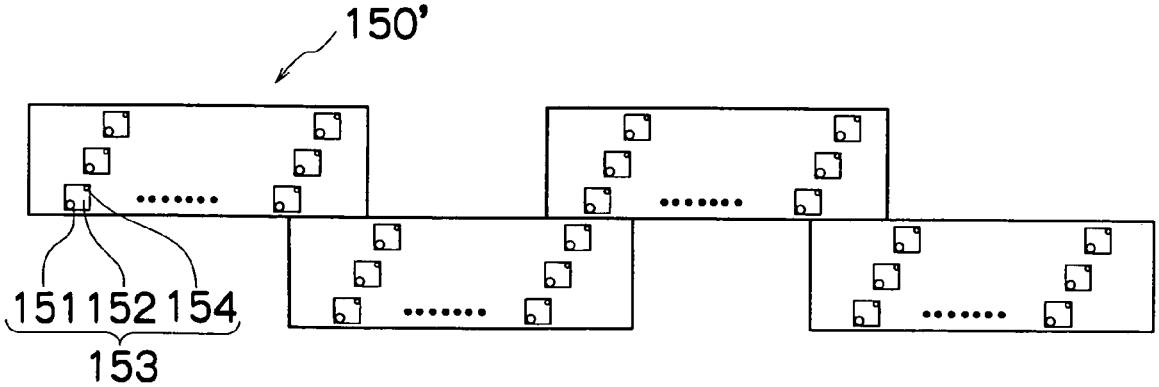
FIG. 12C is a planar perspective view showing another constructional example of a full-line head.
Figure 13:
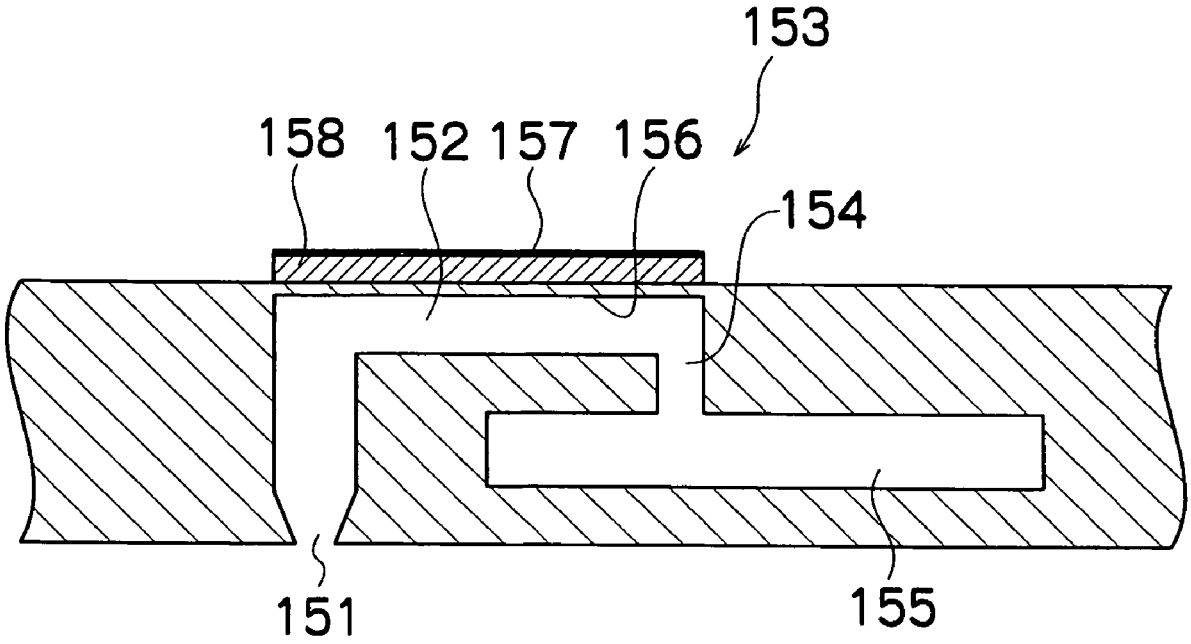
FIG. 13 is a cross sectional view taken along a line 13-13 in FIG. 12A.

FIG. 12A is a perspective planar view showing an example of the configuration of the head 150, FIG. 12B is an enlarged view of a portion thereof, FIG. 12C is a perspective planar view showing another example of the configuration of the head 150, and FIG. 13 is a cross-sectional view taken along the line 13-13 in FIG. 12A, showing the inner structure of an ejection element (an ink chamber unit for one nozzle 151).

The nozzle pitch in the head 150 should be minimized in order to maximize the density of the dots printed on the surface of the recording paper 116. As shown in FIGS. 12A and 12B, the head 150 according to the present embodiment has a structure in which a plurality of ink chamber units (ejection elements) 153, each comprising a nozzle 151 forming an ink ejection port, a pressure chamber 152 corresponding to the nozzle 151, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording paper 116 in a direction substantially perpendicular to the conveyance direction of the recording paper 116 is not limited to the example described above. For example, instead of the configuration in FIG. 12A, as shown in FIG. 12C, a line head having nozzle rows with a length corresponding to the entire width of the recording paper 116 can be formed by arranging and combining, in a staggered matrix, short head modules 150' having a plurality of nozzles 151 arrayed in a two-dimensional fashion.

The planar shape of the pressure chamber 152 provided for each nozzle 151 is substantially a square (see FIGS. 12A and 12B), and an outlet to the nozzle 151 and an inlet of supplied ink (supply port) 154 are disposed in both corners on a diagonal line of the square. It should be noted that the shape of the pressure chamber 152 is not limited to the example of the present embodiment, and thus the planar shape thereof may take various forms such as a quadrilateral (rhombus, rectangle, or the like), pentagon, hexagon, other polygonal shapes, a circle, ellipse, and the like.

As shown in FIG. 13, each pressure chamber 152 is connected to a common channel 155 through the supply port 154. The common channel 155 is connected to an ink tank (not shown), which is a base tank that supplies ink, and the ink supplied from the ink tank is delivered through the common flow channel 155 to the pressure chambers 152.

An actuator 158 having a discrete electrode 157 is joined to a pressure plate (diaphragm used also as a common electrode) 156 which forms a part of the pressure chamber 152 (the ceiling in FIG. 13). The actuator 158 is deformed by applying drive voltage between the discrete electrode 157 and the common electrode to change the volume of the pressure chamber 152, and the ink is ejected from the nozzle 151 due to the pressure change thus produced. A piezoelectric element that includes a piezoelectric substance, such as lead-zirconate-titanate and barium titanate, is preferably used as the actuator 158. After ink is ejected, when the displacement of the actuator 158 is eliminated and the actuator 158 returns to the original state, new ink is delivered from the common flow channel 155 through the supply port 154 to the pressure chamber 152.

Figure 14:
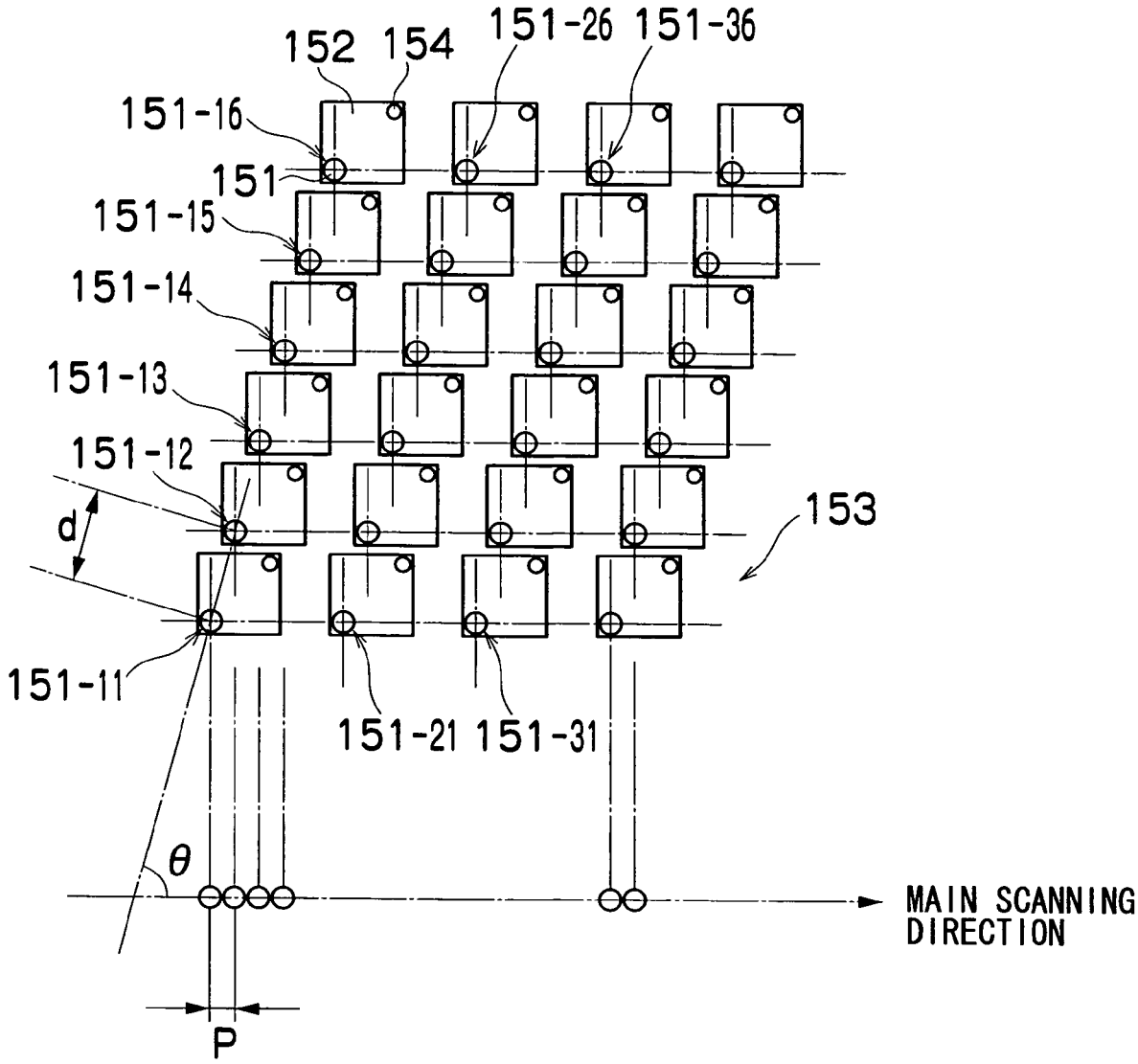
FIG. 14 is an enlarged view showing a nozzle arrangement in the head shown in FIG. 12A.

As shown in FIG. 14, the high-density nozzle head according to the present embodiment is achieved by arranging a plurality of ink chamber units 153 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 153 are arranged at a uniform pitch d in line with a direction forming an angle of θ with respect to the main scanning direction, the pitch P of the nozzles projected so as to align in the main scanning direction is d×cos θ, and hence the nozzles 151 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles according to one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 151 arranged in a matrix such as that shown in FIG. 14 are driven, the main scanning according to the above-described (3) is preferred. More specifically, the nozzles 151-11, 151-12, 151-13, 151-14, 151-15 and 151-16 are treated as a block (additionally; the nozzles 151-21, . . . , 151-26 are treated as another block; the nozzles 151-31, . . . , 151-36 are treated as another block; . . . ); and one line is printed in the width direction of the recording paper 116 by sequentially driving the nozzles 151-11, 151-12, . . . , 151-16 in accordance with the conveyance velocity of the recording paper 116.

On the other hand, "sub-scanning" is defined as to repeatedly perform printing of one line (a line formed of a row of dots, or a line formed of a plurality of rows of dots) formed by the main scanning, while the full-line head and the recording paper are moved relatively to each other.

A direction indicating one line recorded by main scanning described above (or longitudinal direction of a strip-like region) is called "main scanning direction," and the direction in which sub-scanning described above is performed is called "sub-scanning direction". Specifically, in the present embodiment, the conveyance direction of the recording paper 116 is the sub-scanning direction, and the direction perpendicular to the sub-scanning direction is the main scanning direction.

In implementing the present embodiment, the arrangement of the nozzles is not limited to that of the example illustrated. Moreover, a method is employed in the present embodiment where an ink droplet is ejected by means of the deformation of the actuator 158, which is typically a piezoelectric element; however, in implementing the present embodiment, the method used for discharging ink is not limited in particular. Instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Description of Control System

Figure 15:
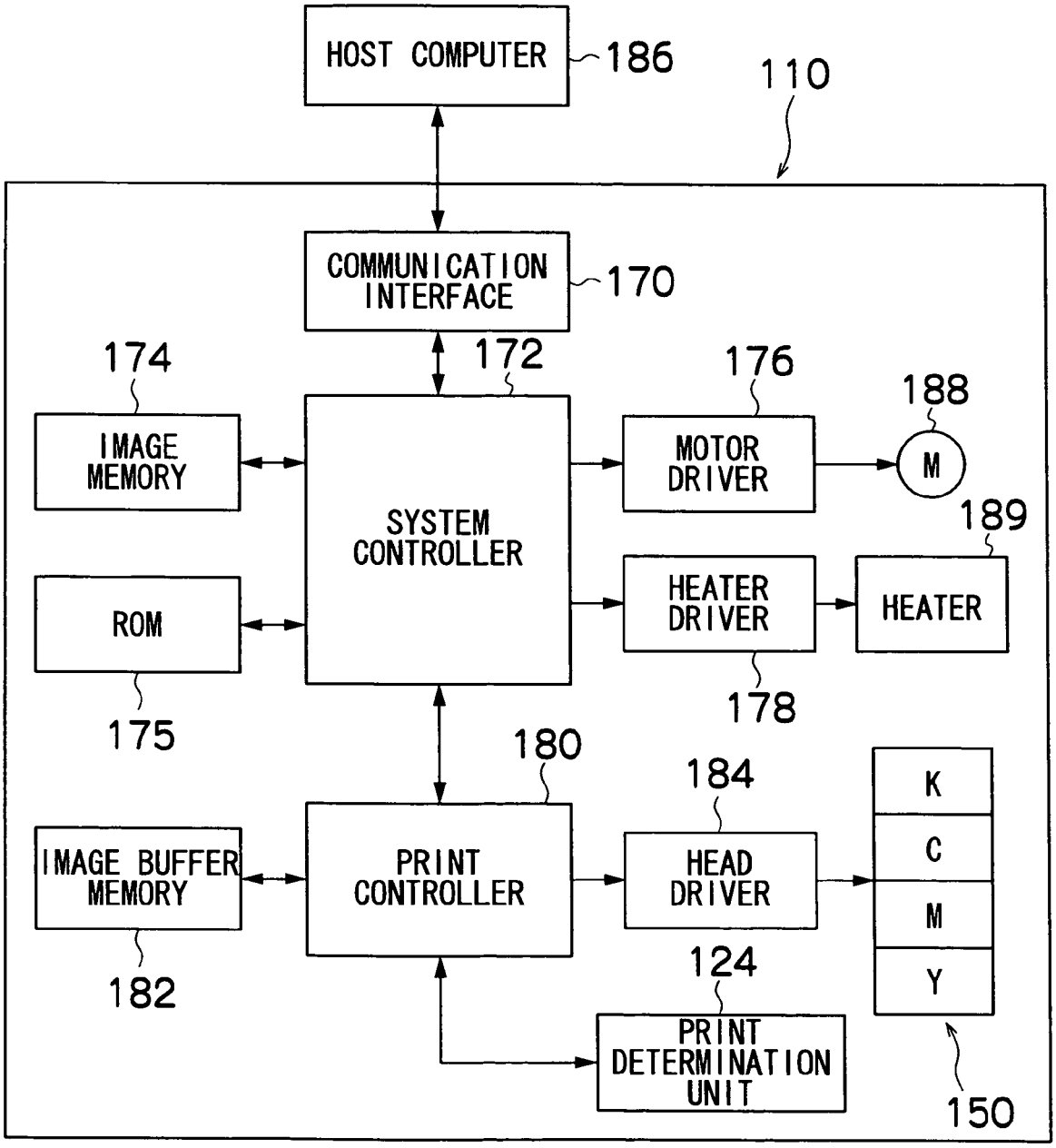
FIG. 15 is a block diagram showing substantial parts in a system configuration of the inkjet recording apparatus according to the present embodiment.

FIG. 15 is a block diagram showing the system configuration of the inkjet recording apparatus 110. As shown in FIG. 15, the inkjet recording apparatus 110 comprises a communication interface 170, a system controller 172, an image memory 174, a ROM 175, a motor driver 176, a heater driver 178, a print controller 180, an image buffer memory 182, a head driver 184, and the like.

The communication interface 170 is an interface unit for receiving image data sent from a host computer 186. A serial interface such as USB, IEEE1394, Ethernet, wireless network, or a parallel interface such as a Centronics interface may be used as the communication interface 170. A buffer memory (not shown) may be mounted in this portion in order to increase the communication speed.

The image data sent from the host computer 186 is received by the inkjet recording apparatus 110 through the communication interface 170, and is stored in the image memory 174. The image memory 174 is a storage device for storing images inputted through the communication interface 170, and data is written and read to and from the image memory 174 through the system controller 172. The image memory 174 is not limited to a memory composed of semiconductor elements, and a hard disk drive or another magnetic medium may be used.

The system controller 172 includes a central processing unit (CPU) and peripheral circuits thereof, and the like, and it functions as a control device for controlling the whole of the inkjet recording apparatus 110 in accordance with a prescribed program, as well as a calculation device for performing various calculations. More specifically, the system controller 172 controls the various sections, such as the communication interface 170, image memory 174, motor driver 176, heater driver 178, and the like, so as to control communications with the host computer 186 and writing and reading to and from the image memory 174 and ROM 175, and to generate control signals for controlling the motor 188 and heater 189 of the conveyance system.

The program executed by the CPU of the system controller 172 and the various types of data that are required for control procedures are stored in the ROM 175. The ROM 175 may be a non-rewriteable storage device, or it may be a rewriteable storage device such as an EEPROM. The image memory 174 is used as a temporary storage region for the image data, and it is also used as a program development region and a calculation work region for the CPU.

The motor driver (drive circuit) 176 drives the motor 188 of the conveyance system in accordance with commands from the system controller 172. The heater driver (drive circuit) 178 drives the heater 189 of the post-drying unit 142 or the like in accordance with commands from the system controller 172.

The print controller 180 has a signal processing function for performing various tasks, compensations, and other types of processing for generating print control signals from the image data (original image date) stored in the image memory 174 in accordance with commands from the system controller 172 so as to supply the generated print data (dot data) to the head driver 184.

The print controller 180 is provided with the image buffer memory 182, and image data, parameters, and other data are temporarily stored in the image buffer memory 182 when image data is processed in the print controller 180. It should be noted that the example shown in FIG. 15 is one in which the image buffer memory 182 accompanies the print controller 180, but the image memory 174 also serves as the image buffer memory 182. In addition, an example is possible in which the print controller 180 and the system controller 172 are integrated to form a single processor.

To give an outline of the process sequence from image input to print output, data of the image to be printed is input from outside via the communication interface 170, and stored in the image memory 174. In this stage, for example, image data of RGB is stored in the image memory 174.

In the inkjet recording apparatus 110, a pseudo image with continuous tone is formed by changing fine droplet density or the dot size in accordance with the ink (ink material), and thus it is necessary to modify the image data to a dot pattern such that the tone of the input digital image (shade of the image) can be realized as faithfully as possible. Therefore, the data of the original image (RGB) stored in the image memory 174 is sent to the print controller 180 via the system controller 172, and modified to the dot data for each ink color by being subjected to the halftone processing using a dither method or error diffusion method in the print controller 180.

Specifically, the print controller 180 performs processing of modifying the input RGB image data to the dot data for four colors of K, C, M, and Y. The dot data thereby generated by the print controller 180 is stored in the image buffer memory 182.

The head driver 184 outputs a drive signal for driving the actuator 158 corresponding to each nozzle 151 of the head 150, on the basis of the print data provided by the print controller 180 (i.e., dot data stored in the image buffer memory 182). The head driver 184 may comprise a feedback control system for maintaining the drive conditions of the head constantly.

The drive signal that is output from the head driver 184 is transmitted to the head 150, and whereby the ink is ejected from the corresponding nozzles 151. By controlling the ejection of the ink from the head 150 in synchronization with the conveyance speed of the recording paper 116, an image is formed on the recording paper 116.

As described above, the amount of ink droplets to be ejected from each nozzle and the ejection timing are controlled via the head driver 184 on the basis of the dot data that is generated by going through the required signal processing in the print controller 180. Accordingly, a desired dot size and a dot arrangement are realized.

The print determination unit 124 is, as described with reference to FIG. 10, a block having an image sensor, reads an image printed on the recording paper 116, determines a print situation (the presence of the ejection, diffusion of the droplets, optical density, and the like) by performing the required signal processing, and provides a result of the determination to the print controller 180. It should be noted that other ejection determination device (same as an ejection abnormality determination device) may be provided instead of or in combination with the print determination unit 124.

As another ejection determination device, for example, an example (internal detection method) is possible in which a pressure sensor is provided inside or in the vicinity of each pressure chamber 152 of the head 150 to determine ejection abnormality according to a determination signal obtained from this pressure sensor when ink is ejected or when the actuator for measuring pressure is driven. Moreover, an example (external detection method) is possible in which an optical determination system having a light source such as a laser light emitting device to irradiate the droplets ejected form the nozzle with light such as laser light and a light receiving element is used, and whereby dispersed droplets are determined according to the amount (luminous energy) of the transmitted light (received light).

The print controller 180 performs various corrections with respect to the head 150 on the basis of information obtained from the print determination unit 124 or the ejection determination device (not shown) according to need. The print controller 180 also controls preliminary discharge, suction, and cleaning operation such as wiping (nozzle recovery operation) according to need.

According to the inkjet recording apparatus 110 with the configuration described above, in consideration of the spectral characteristics of the ink, the head arrangement order is designed so that the recording can be performed in the deposition order in which color reproduction of an image with higher density is possible. Thus, an image with high color reproductiveness can be formed.

The above embodiments have described an inkjet recording apparatus that uses a page-wide full-line head having a row of nozzles with a length corresponding to the entire width of the recording medium, but the applicable scope of the present invention is not limited to these embodiments. For example, the present invention can be applied to a case in which the line head (referred to as "print head 250" hereinafter) with a length shorter than the width Wm of the recording medium (recording paper 116 and other print media) 216 is used to scan the recording medium a number of times, thereby forming an image, as shown in FIGS. 16A and 16B.

Figure 16B:
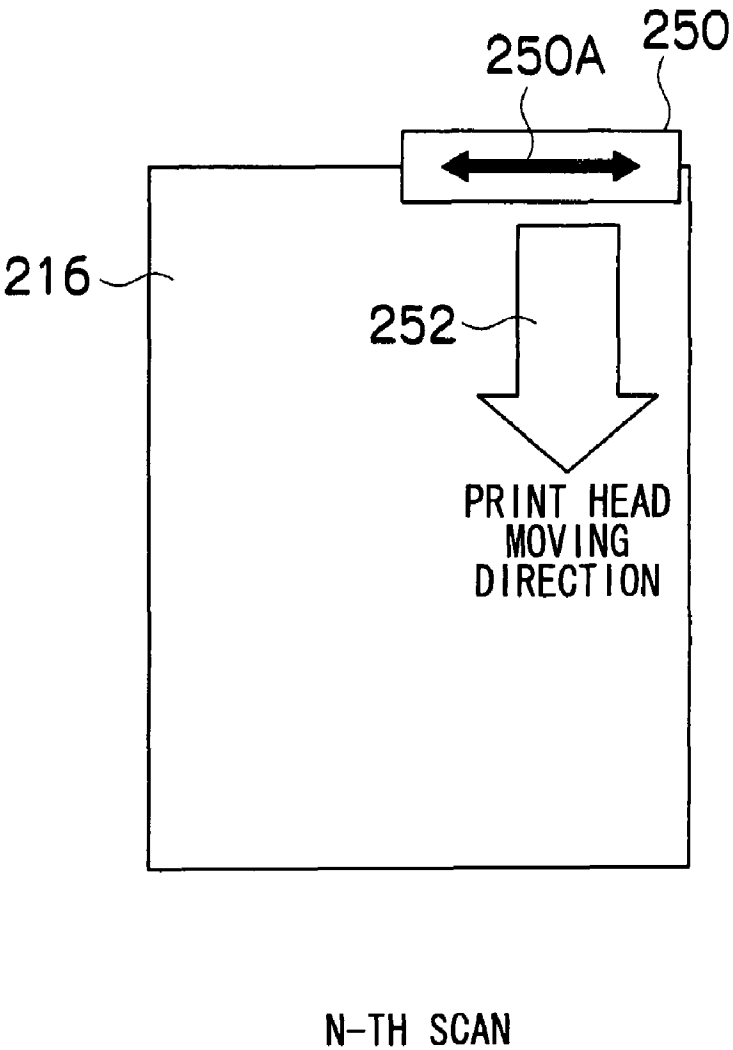
FIGS. 16A and 16B are schematic diagrams showing an example of an embodiment in which a scanning type print head is used to form an image.
Figure 16A:
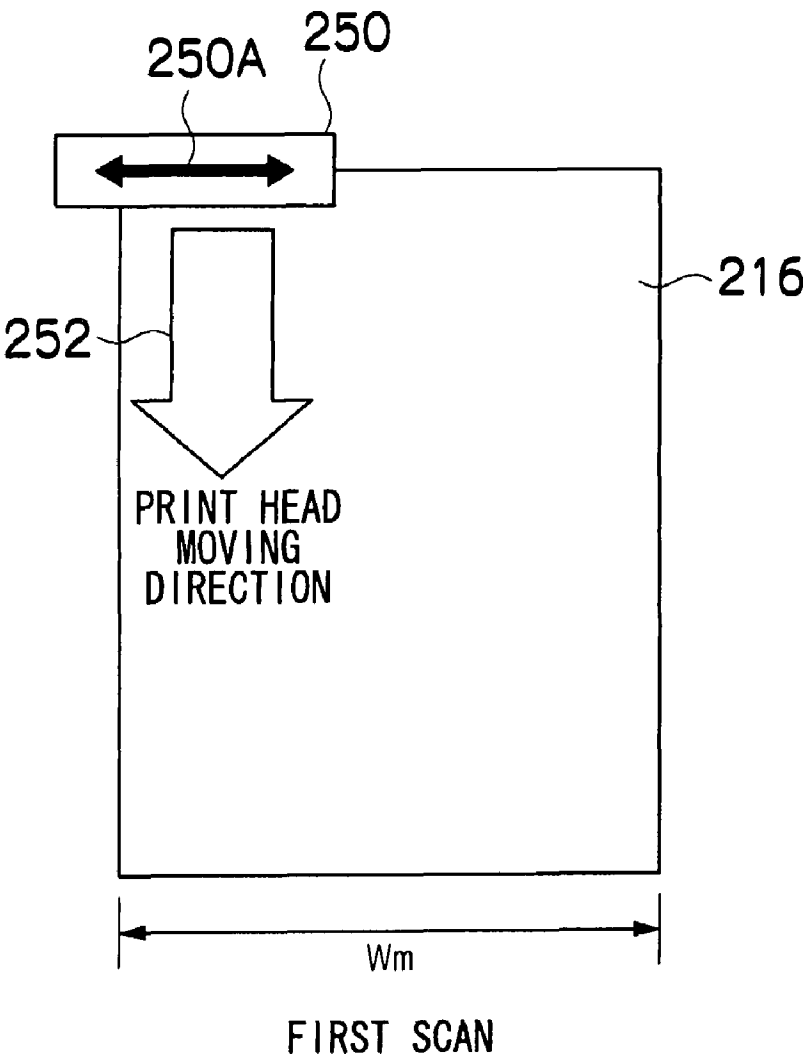

It should be noted that arrows 250A directing to both sides and illustrated in the print head 250 in FIGS. 16A and 16B schematically indicate the direction in which the nozzles are aligned and the length of the nozzle row. Outline arrows 252 indicate the main scanning direction of the print head. FIG. 16A shows a state in which first scan is performed, and FIG. 16B shows a state in which N-th scan (where N is an integer of 2 or above) is performed after changing the scanning position.

As shown in FIGS. 16A and 16B, the print head 250 is disposed so that the longitudinal direction thereof (nozzle alignment direction) follows the width direction of the recording medium 216, and is supported by a head moving device (not shown) (including a carriage, supporting mechanism such as a scanning guide, and a driver such as a motor for driving this) so as to be capable of moving in the print head moving direction (direction indicated by the outline arrows 252) and the width direction of the recording medium 216 (horizontal direction in FIGS. 16A and 16B).

By performing the multi-scanning in the print head moving direction 252 while the position (scanning position) of the print head 250 with respect to the width direction of the recording medium 216 is changed, an image is formed on the recording medium 216.

It should be noted that an example of moving the print head 250 is described above; however, the scanning may be performed by relatively moving the print head 250 with respect to the recording medium 216. In other words, an example in which the recording medium 216 is moved, or an example in which the scanning is performed by combining of both the movements of the print head 250 and the recording medium 216 are possible.

Figure 17:
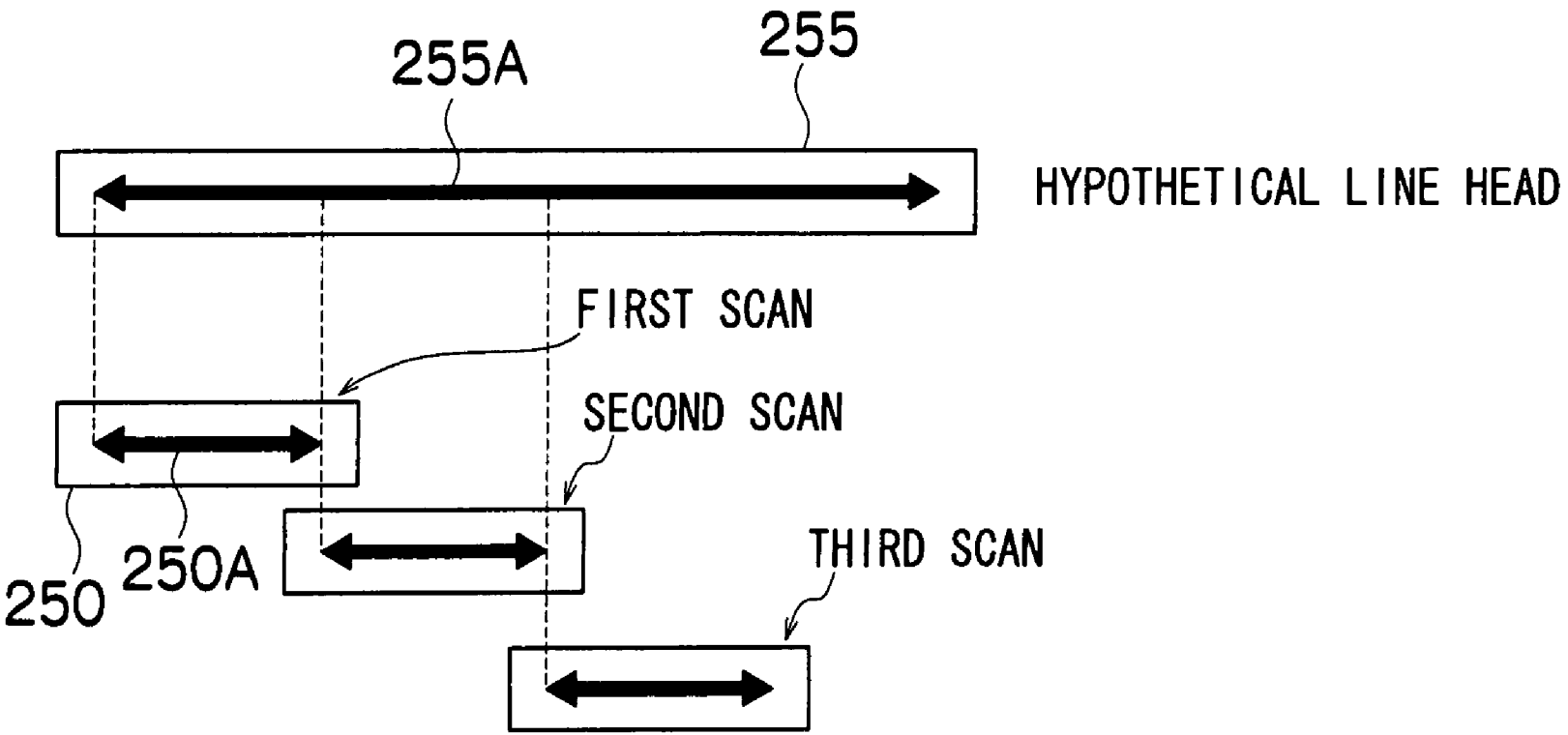
FIG. 17 is an explanatory diagram showing the relationship between a plurality of scanning operations and a hypothetical line head.

As shown in FIGS. 16A and 16B, the print head 250 performs the scanning at different positions for every scanning operation. By regarding the nozzles moved relatively on the recording medium 216 as the nozzles located in the corresponding positions on the line head 255 having a hypothetical recording medium width (Wm) as shown in FIG. 17, the print head 250 can be regarded as a part of the hypothetical line head 255 having a nozzle row 255A with a length corresponding to the width Wm of the recording medium 216. Specifically, the present invention can be applied to this hypothetical line head (full-line type of the head) 255 as in the embodiment for the full-line head 150, which has been already described above.

Example of Application to Shuttle Scan Type Inkjet Recording Apparatus

Figure 18:
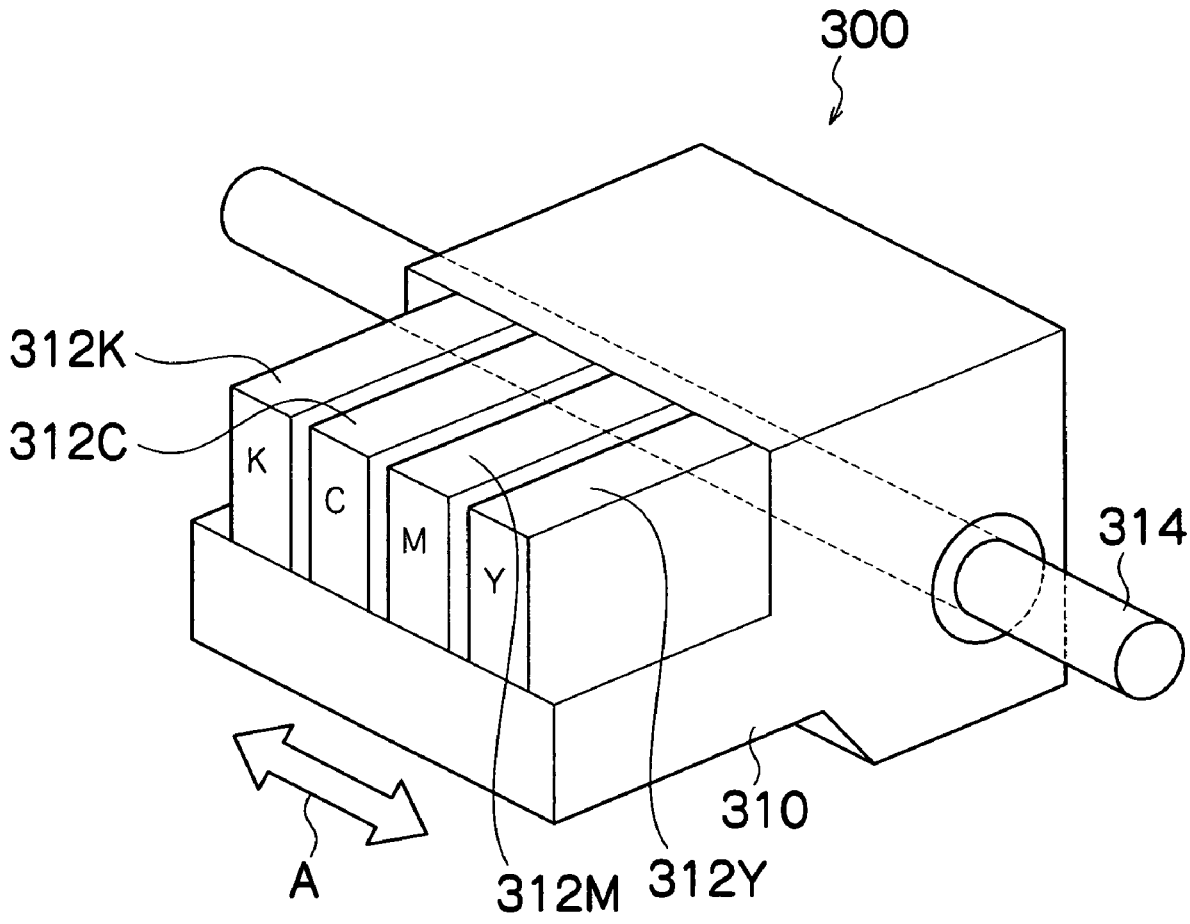
FIG. 18 is an oblique perspective view of substantial parts of a print head unit, which is used, in a shuttle scan type of inkjet recording apparatus.

Next, an example of application to the shuttle scan type of the inkjet recording apparatus is described below. FIG. 18 is an oblique perspective view of substantial parts of the print head unit that is used in the shuttle scan type of the inkjet recording apparatus. Instead of the printing unit 112 of the inkjet apparatus 10 described with reference to FIG. 10, a print head unit 300 shown in FIG. 18 is provided.

As shown in FIG. 18, the print head unit 300 includes a head module 312K (referred to as "K head" hereinafter) for black ink, a head module 312C (referred to as "C head" hereinafter) for cyan ink, a head module 312M (referred to as "M head" hereinafter) for magenta ink, and a head module 312Y (referred to as "Y head" hereinafter) for yellow ink. These head modules 312K, 312C, 312M, and 312Y are disposed on a carriage 310. The carriage 310 is supported by a guide member 314 (the guide member 314 can be also called "guide rail" or "carriage shaft") extending in the direction perpendicular to the conveyance direction of the recording medium (direction indicated with an outline arrow A in FIG. 18), and can be moved back and forth along the guide member 314 by a carriage driver including a motor (not shown).

Figure 19:
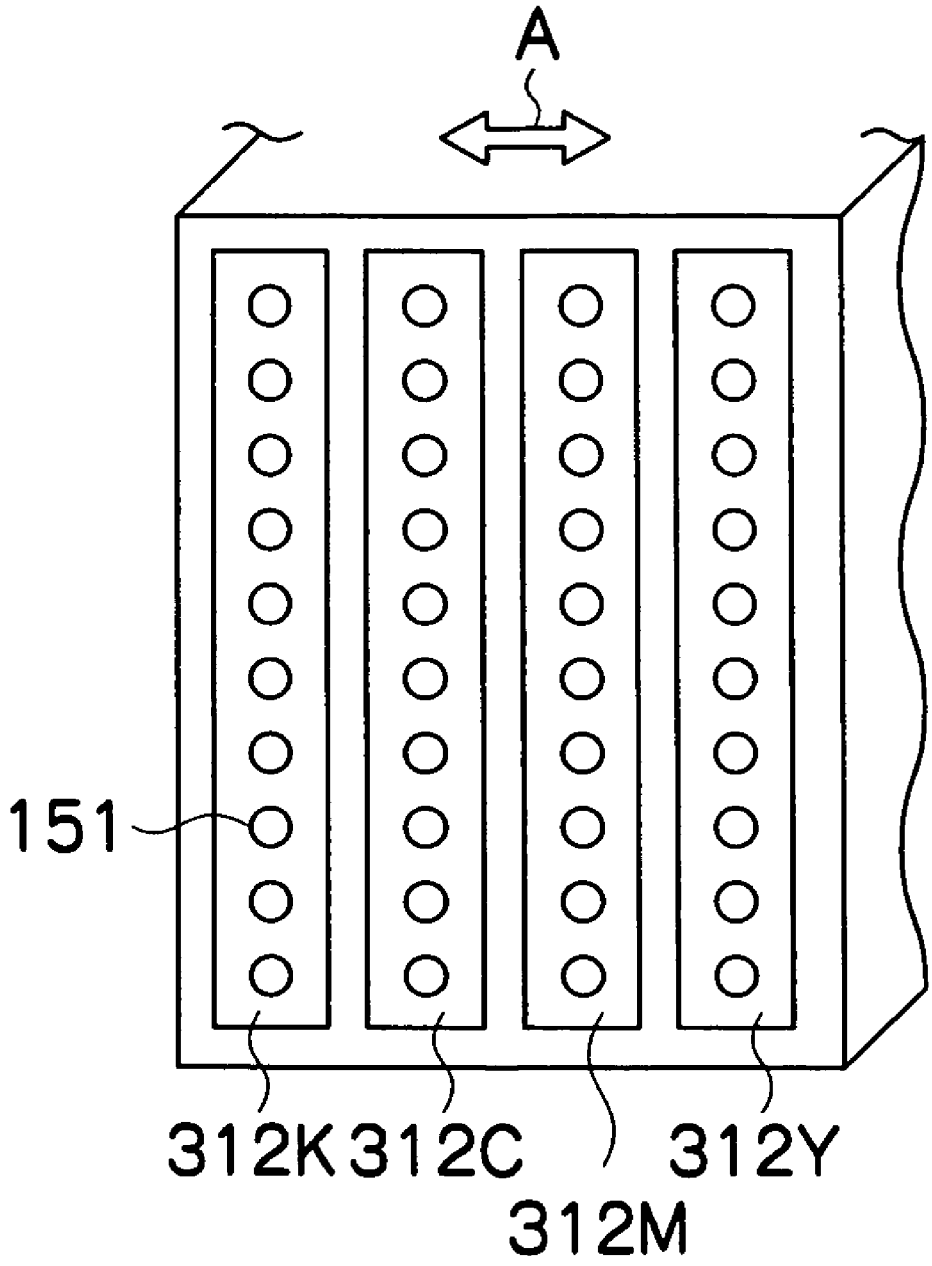
FIG. 19 is a schematic diagram showing a state in which the print head unit shown in FIG. 18 is viewed from the ink ejection side.

FIG. 19 is a schematic diagram showing a state in which the print head unit 300 is viewed from the ink ejection side. FIG. 19 shows an example in which each of the heads 312K, 312C, 312M, and 312Y has one row of the nozzles; however, each of the heads may have a plurality of the nozzle rows. Further, the head modules are respectively provided for the colors in the present example; however, it is possible that a plurality of nozzle rows are formed for the colors in one head so that a plurality of colors of inks can be ejected from the single head.

In the case of the shuttle scan type inkjet recording apparatus, the order of overlapping inks on the recording medium (the order of the deposition) can be controlled as described above with reference to FIGS. 21A and 21B. Thus, the alignment order of the heads 312K, 312C, 312M, and 312Y (or the alignment order of the nozzle rows) for the colors on the carriage 310 is not particularly limited.

The system configuration is almost the same as the example described with FIG. 15. However, the information on the deposition order which is determined by the color ink deposition order determination method according to the above-mentioned embodiments, is stored in the storage device such as a ROM 175, and the ejection operation by the heads 312K, 312C, 312M, and 312Y for the color inks is controlled so that the color inks overlap on the recording medium 216 in accordance with the deposition order.

Moreover, the print determination unit 124 is also used as a device for measuring the densities of the deposition samples. The print data for printing the deposition sample for measuring the density is stored in the ROM 175, this print data for measuring the density is read out according to need, and the printing is performed. The deposition sample of the print result is read out by the print determination unit 124 to obtain the density information, and whereby a color ink deposition order is determined according to the above-mentioned algorithm.

Specifically, the print determination unit 124 shown in FIG. 15 functions as "density information obtaining device" in the present invention. The system controller 172, the print controller 180, or the combination of the system controller 172 and the print controller 180 functions as a "deposition order determination device" and an "ejection control device" in the present invention.

Figure 20B:
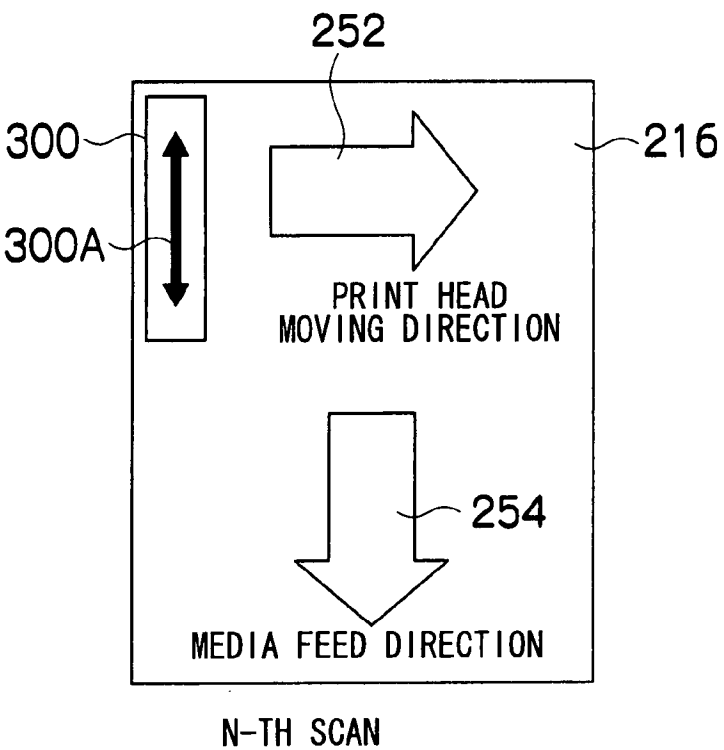
FIGS. 20A and 20B are schematic diagrams showing an embodiment in which a shuttle scan type print head unit is used to form an image.
Figure 20A:
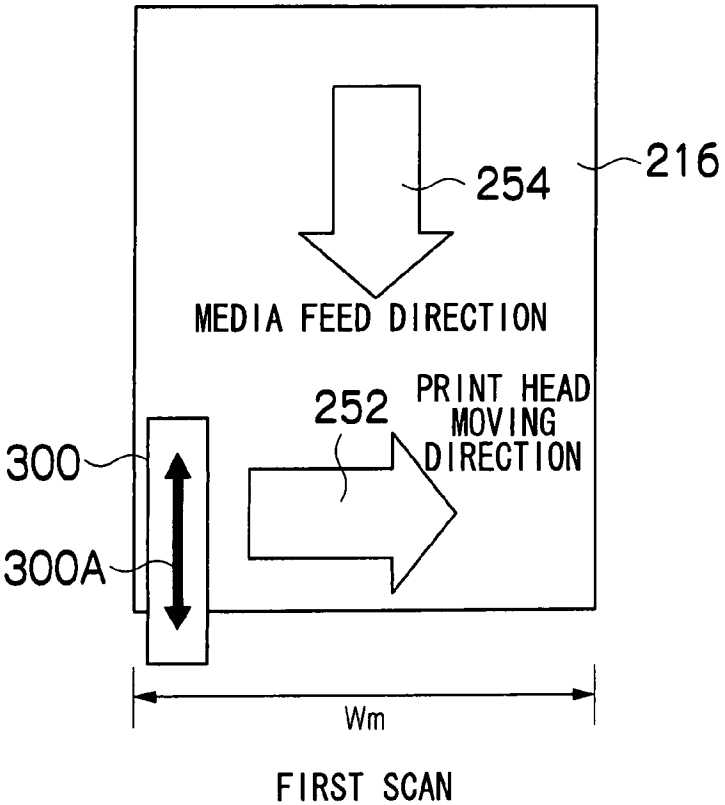

According to the inkjet recording apparatus including the print head unit 300 described above with reference to FIGS. 18 and 19, an image is formed by ejecting the inks while the print head unit 300 is moved, as shown in FIGS. 20A and 20B. It should be noted that, in FIGS. 20A and 20B, the same reference numerals are applied to the same or similar elements as the ones in FIGS. 16A and 16B, and thus the explanations are omitted.

In FIGS. 20A and 20B, the print head unit 300 is disposed so that the longitudinal direction (nozzle alignment direction) thereof corresponds to the feed direction of the recording medium 216 (media feed direction shown with an outline arrow 254), and the print head unit 300 performs the scanning in a direction substantially perpendicular to the media feed direction.

Because of the combination of the scanning performed by the print head unit 300 and the movement of the recording medium 216, an image is formed on the recording medium 216 by performing the multi-scanning during changing the relative position of the print head unit 300 with respect to the recording medium 216.

As mentioned above, in consideration of the spectral characteristics of the inks, the ejection is controlled so that the recording is performed in the deposition order where color reproduction of an image with higher density is possible, and thus an image with high color reproductiveness can be formed.

Modified Embodiment 1

When the different kinds of the ink sets are used for printing, a deposition order is determined for each of the ink sets by obtaining the spectral absorption of the inks according to the method described in the first embodiment or the second embodiment. In the case of single pulse type, an example is possible in which the single pulse type of the inkjet recording apparatus is provided with a mechanism and a movement control device thereof for moving the heads so as to change the alignment order of the, heads for the color inks according to the determined deposition order.

Furthermore, an example is possible in which the conveyance system is controlled in a way that the recording medium is conveyed a number of times with respect to the nozzle rows so that the droplets are deposited in the determined deposition order.

Modified Embodiment 2

When the characteristics of "three-cornered deadlock" described in FIGS. 3 and 7 is shown in the single pulse type, an example is possible in which two heads concerning one of the cyan (C), magenta (M), and yellow (Y) are provided. For example, in the case of ($\alpha$) in FIG. 3, if the heads in the order of C, M, Y, and C are disposed from the upstream side to the downstream side, then the ink droplets are deposited in the order of C to M for the combination of C and M, in the order of M to Y for the combination of M and Y, and in the order of Y to C for the combination of Y and C. Preferably, the two heads correspond to the color having the lowest density in the single color.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method of determining a color ink deposition order when inks of a plurality of colors are overlapped on one another to form an image on a recording medium, the method comprising the steps of:

obtaining information on OD_β(α) concerning an ink of a first color α and OD_α(β) concerning an ink of a second color β, where OD_β(α) is a reflection density in a range of a color complementary to the second color β in a deposition sample obtained when only the ink of the first color α is deposited, and OD_α(β) is a reflection density in a range of a color complementary to the first color α in a deposition sample obtained when only the ink of the second color β is deposited; and determining the color ink deposition order so that of one of the inks of the first color α and the second color β which one corresponds to smaller one of OD_β(α) and OD_α(β) is first deposited and the other of the inks of the first color α and the second color β is subsequently deposited.

2. The method as defined in claim 1, wherein the first color α and the second color β are two colors selected from among three colors of cyan, magenta, and yellow.

3. The method as defined in claim 2, further comprising the steps of:

where OD_M (C) is a reflection density in a range of color complementary to magenta in a deposition sample obtained when only cyan ink is deposited, OD_C (M) is a reflection density in a range of color complementary to cyan in a deposition sample obtained when only magenta ink is deposited, OD_Y (M) is a reflection density in a range of color complementary to yellow in a deposition sample obtained when only the magenta ink is deposited, OD_M (Y) is a reflection density in the range of color complementary to magenta in a deposition sample obtained when only yellow ink is deposited, OD_C (Y) is a reflection density in the range of color complementary to cyan in a deposition sample obtained when only the yellow ink is deposited, and OD_Y (C) is a reflection density in the range of color complementary to yellow in a deposition sample obtained when only the cyan ink is deposited, in one of a case where all of inequalities of OD_C (M)>OD_M (C), OD_M (Y)>OD_Y (M), and OD_Y (C)>OD_C (Y) are satisfied and a case where all of inequalities of OD_C (M)<OD_M (C), OD_M (Y)<OD_Y (M), and OD_Y (C)<OD_C (Y), obtaining values of |OD_C (M)−OD_M (C)|, |OD_M (Y)−OD_Y (M)|, and |OD_Y (C)−OD_C (Y)| and selecting two pairs of the colors corresponding to larger two of the obtained values; and determining the color ink deposition order of the inks of cyan, magenta, and yellow according to the inequalities corresponding to the two pairs of the colors.

4. The method as defined in claim 1, wherein each of the deposition samples is created by depositing the ink of an amount per unit area corresponding to an amount in a case where the ink is deposited at a maximum dot density.

5. An image forming method, comprising the steps of:

determining a color ink deposition order according to the method as defined in claim 1; and ejecting the inks of the colors to form a color image according to the determined color ink deposition order.

6. An image forming apparatus comprising ink ejection heads for the inks of the colors, the heads being disposed from upstream side to downstream side with respect to a conveyance direction of the recording medium in accordance with the color ink deposition order determined according to the method as defined in claim 1.

7. A method of determining a color ink deposition order when inks of a plurality of colors are overlapped on one another to form an image on a recording medium, the method comprising the steps of:

obtaining information on OD_α(α→β), OD_β(α→β), OD_α(β→α), and OD_β(β→α), where OD_α(α→β) is a reflection density in a range of a color complementary to a first color α in a deposition sample obtained when an ink of a second color β is deposited on an ink of the first color α, OD_β(α→β) is a reflection density in a range of a color complementary to the second color β in the deposition sample obtained when the ink of the second color β is deposited on the ink of the first color α, OD_α(β→α) is a reflection density in the range of the color complementary to the first color α in a deposition sample obtained when the ink of the first color α is deposited on the ink of the second color β, and OD_β(β→α) is a reflection density in the range of the color complementary to the second color β in the deposition sample obtained when the ink of the first color α is deposited on the ink of the second color β; and determining the color ink deposition order of the inks of the first color α and the second color β according to values of OD_α(α→β), OD_β(α→β), OD_α(β→α), and OD_β(β→α).

8. The method as defined in claim 7, wherein, if conditions of OD_α(β→α)>OD_α(α→β) and OD_β(β→α) >OD_β(α→β) are satisfied, then the color ink deposition order is determined so that the ink of the second color β is first deposited and the ink of the first color α is subsequently deposited.

9. The method as defined in claim 7, wherein, if conditions of OD_α(α→β)>OD_α(β→α) and OD_β(α→β) >OD_β(β→α) are satisfied, then the color ink deposition order is determined so that the ink of the first color α is first deposited and the ink β of the second color β is subsequently deposited.

10. The method as defined in claim 7, wherein:

if conditions of OD_α (β→α)>OD_α(α→β) and OD_β (β→α)>OD_β(α→β) are satisfied, then the method further comprises the steps of:

obtaining information on OD_α(α) and OD_β(β), where OD_α(α) is a reflection density in the range of the color complementary to the first color α in a deposition sample obtained when only the ink of the first color α is deposited, and OD_β(β) is a reflection density in the range of the color complementary to the second color β in a deposition sample obtained when only the ink of the second color β is deposited;

obtaining a first value of {OD_α(α)−OD_α(α→β)} and a second value of {OD_β(β)−OD_β(β→α)}; and determining the color ink deposition order so that the ink of the first color α is first deposited and the ink β of the second color β is subsequently deposited if the first value is smaller than the second value, and the ink of the second color β is first deposited and the ink of the first color α is subsequently deposited if the second value is smaller than the first value.

11. The method as defined in claim 7, wherein the first color α and the second color β are two colors selected from among three colors of cyan, magenta, and yellow.

12. A color ink deposition order determination method, comprising the steps of:

determining deposition orders of inks of two colors in combinations of cyan and magenta, magenta and yellow, and yellow and cyan, according to the method as defined in claim 11;

if the deposition order of the inks of three colors cyan, magenta, and yellow is not uniquely determined according to the determined deposition orders, then obtaining change values of the combinations, each of the change values being a change value between the reflection density obtained when the inks of the two colors are deposited in the determined deposition order and a reflection density obtained when the inks of the two colors are deposited in an order reverse to the determined deposition order;

selecting two of the combinations of which the change values are larger than the change value of the other combination; and determining the color ink deposition order of the inks of the three colors, cyan, magenta, and yellow according to the determined deposition orders corresponding to the selected two combinations.

13. The method as defined in claim 12, wherein each of the deposition samples is created by depositing the ink of an amount per unit area corresponding to a half of an amount in a case where the ink is deposited at a maximum dot density.

14. An image forming method, comprising the steps of:

determining a color ink deposition order according to the method as defined in claim 12; and ejecting the inks of the colors to form a color image according to the determined color ink deposition order.

15. An image forming apparatus comprising ink ejection heads for the inks of the colors, the heads being disposed from upstream side to downstream side with respect to a conveyance direction of the recording medium in accordance with the color ink deposition order determined according to the method as defined in claim 12.

16. The method as defined in claim 7, wherein each of the deposition samples is created by depositing the ink of an amount per unit area corresponding to a half of an amount in a case where the ink is deposited at a maximum dot density.

17. An image forming method, comprising the steps of:

determining a color ink deposition order according to the method as defined in claim 7; and ejecting the inks of the colors to form a color image according to the determined color ink deposition order.

18. An image forming apparatus comprising ink ejection heads for the inks of the colors, the heads being disposed from upstream side to downstream side with respect to a conveyance direction of the recording medium in accordance with the color ink deposition order determined according to the method as defined in claim 7.

19. An image forming apparatus, comprising:

an ink ejection head having a nozzle row ejecting inks of the plurality of colors;

a scanning device by which the ink ejection head is moved relatively to a recording medium so that the ink ejection head scans a recording region on the recording medium a plurality of times;

a density information obtaining device which obtains information on OD_β(α) concerning the ink of a first color α of the plurality of colors and OD_α(β) concerning the ink of a second color β of the plurality of colors, where OD_β(α) is a reflection density in a range of a color complementary to the second color β in a deposition sample obtained when only the ink of the first color α is deposited, and OD_α(β) is a reflection density in a range of a color complementary to the first color α in a deposition sample obtained when only the ink of the second color β is deposited;

a deposition order determination device which determines a deposition order so that one of the inks of the first color α and the second color β which one corresponds to smaller one of OD_β(α) and OD_α(β) is first deposited and the other of the inks of the first color α and the second color β is subsequently deposited; and an ejection control device which controls operation of the ink ejection head so that the inks overlap on one another on the recording medium in accordance with the deposition order determined by the deposition order determination device.

20. An image forming apparatus, comprising:

an ink ejection head having a nozzle row ejecting inks of the plurality of colors;

a scanning device by which the ink ejection head is moved relatively to a recording medium so that the ink ejection head scans a recording region on the recording medium a plurality of times;

a density information obtaining device which obtains information on OD_α(α→β), OD_β(α→β), OD_α(β→α), and OD_β(β→α), where OD_α(α→β) is a reflection density in a range of a color complementary to a first color α in a deposition sample obtained when an ink of a second color β is deposited on an ink of the first color α, OD_β(α→β) is a reflection density in a range of a color complementary to the second color β in the deposition sample obtained when the ink of the second color β is deposited on the ink of the first color α, OD_α(β→α) is a reflection density in the range of the color complementary to the first color α in a deposition sample obtained when the ink of the first color α is deposited on the ink of the second color β, and OD_β(β→α) is a reflection density in the range of the color complementary to the second color β in the deposition sample obtained when the ink of the first color α is deposited on the ink of the second color β;

a deposition order determination device which determines a deposition order of the inks of the first color α and the second color β according to values of OD_α(α→β), OD_β(α→β), OD_α(β→α), and OD_β(β→α) obtained by the density information obtaining device; and an ejection control device which controls operation of the ink ejection head so that the inks overlap on one another on the recording medium in accordance with the deposition order determined by the deposition order determination device.

* * * * *